US009056342B2

(12) United States Patent
Imanari

(10) Patent No.: US 9,056,342 B2
(45) Date of Patent: Jun. 16, 2015

(54) ROLLED MATERIAL COOLING CONTROL APPARATUS, ROLLED MATERIAL COOLING CONTROL METHOD, AND ROLLED MATERIAL COOLING CONTROL PROGRAM

(75) Inventor: Hiroyuki Imanari, Minato-ku (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 464 days.

(21) Appl. No.: 13/640,167

(22) PCT Filed: Apr. 9, 2010

(86) PCT No.: PCT/JP2010/056453
§ 371 (c)(1),
(2), (4) Date: Oct. 9, 2012

(87) PCT Pub. No.: WO2011/125221
PCT Pub. Date: Oct. 13, 2011

(65) Prior Publication Data
US 2013/0030561 A1 Jan. 31, 2013

(51) Int. Cl.
*G06F 19/00* (2011.01)
*B21B 37/76* (2006.01)

(52) U.S. Cl.
CPC ..... *B21B 37/76* (2013.01)

(58) Field of Classification Search
CPC ..... B21B 37/76
USPC ..... 700/153
See application file for complete search history.

(56) References Cited

U.S. PATENT DOCUMENTS 7,617,709 B2 * 11/2009 Sano et al. ..... 72/7.1

FOREIGN PATENT DOCUMENTS

| | | | |
|---|---|---|---|
| CN | 1913984 | A | 2/2007 |
| CN | 101204717 | A | 6/2008 |
| CN | 101502849 | A | 8/2009 |
| CN | 101537432 | A | 9/2009 |
| DE | 101 56 008 | A1 | 6/2003 |
| JP | 2000 167615 | | 6/2000 |
| JP | 2001-334305 | A | 12/2001 |
| JP | 2003 39109 | | 2/2003 |

(Continued)

OTHER PUBLICATIONS

International Search Report Issued Jul. 13, 2010 in PCT/JP10/56453 Filed Apr. 9, 2010.

*Primary Examiner* — Robert Fennema
*Assistant Examiner* — Sivalingam Sivanesan
(74) *Attorney, Agent, or Firm* — Oblon, McClelland, Maier & Neustadt, L.L.P.

(57) ABSTRACT

A detail thermal model memory has stored detail thermal models each including a mathematical formula using parameters describing a temperature variation of a rolling material in a prescribed cooling interval, an influence coefficient calculator calculate an influence coefficient as necessary for a control of temperature variation of the rolling material, a simple cooling pattern calculator calculate a simple cooling pattern in a simplified form of a preferable detail cooling pattern being necessary for the rolling material to have a preferable material quality, strength, or ductility, a detail cooling pattern calculator calculate a detail cooling pattern of the rolling material in the prescribed cooling interval, and a cooling controller takes the detail cooling pattern as a basis to control a cooling of the rolling material.

8 Claims, 14 Drawing Sheets

(56) References Cited

FOREIGN PATENT DOCUMENTS

| | | | | | |
|---|---|---|---|---|---|
| JP | 2004 34122 | | 2/2004 | | |
| JP | 2005 297015 | | 10/2005 | | |
| JP | 2007-268540 | A | 10/2007 | | |
| JP | 2009 113111 | | 5/2009 | | |
| JP | 2009 160599 | | 7/2009 | | |
| JP | 2009160599 | A * | 7/2009 | ..... | B21B 37/76 |

* cited by examiner

ROLLED MATERIAL COOLING CONTROL APPARATUS, ROLLED MATERIAL COOLING CONTROL METHOD, AND ROLLED MATERIAL COOLING CONTROL PROGRAM

TECHNICAL FIELD

Embodiments described herein generally relate to a rolling material cooling control apparatus, a rolling material cooling control method, and a rolling material cooling control program each adapted to control cooling temperatures of a rolling material.

BACKGROUND ART

For cooling services to rolling materials there are control apparatuses of such a type that employs a thermal model of a rolling material, to determine a cooling pattern for use to make a cooling control. As such rolling material cooling control apparatuses, there have been those not simply adapted to determine a cooling water amount pattern for a rolling material, for instance, at a time before an entry of the rolling material to a transfer table, but also adapted to determine cooling water amounts online, taking into account variations in temperature at entries of cooling banks as well as variations in speed of the rolling material, to make valve operations in accordance therewith. More specifically, there have been proposed rolling material cooling control apparatuses (e.g. refer to PTL1 below) for services taking strip segments of a rolling material provisionally divided in the direction of its travel, as units of a cooling control. They included an implement for calculation, and an implement for correction. The implement for calculation was operable for each cooling control unit to calculate an initial cooling length based on a detail thermal model combined with information on setup calculations in a hot strip rolling line. The implement for correction was operable to make a correction of the initial cooling length associated with a combination of a deviation that a detected temperature had to a temperature derived from setup calculations for the rolling material at the delivery of the hot strip rolling line and a deviation that a detected average speed had to an average speed derived from setup calculations in the rolling line.

Also, there have been other apparatuses (e.g. PTL2 through PTL4 below) adapted to control a cooling of a rolling material based on a thermal model of the rolling material.

CITATION LIST

Patent Literature

PTL1: JP 2004-34122 A
PTL2: JP 2005-297015 A
PTL3: JP 2003-039109 A
PTL4: JP 2000-167615 A

SUMMARY

Technical Problem

By the way, as for recent rolling materials such as high-class steel strips, required levels of product quality and material quality have been very high. In each of some cases, there was employed a detailed thermal model (referred herein to as a detail thermal model) described with complexity using a plurality of parameters for carrying out a high-precision control of cooling temperature in the production.

However, in rolling material cooling control apparatuses in the background art, when employing a detail thermal model for a rolling material, the detail thermal model was used to directly determine a cooling pattern. As used herein, the term 'cooling pattern' means either or both of a pattern of temperature history that a rolling material is to trace when cooled, and a pattern of water injection to be followed to realize the temperature history. It is noted that when a cooling pattern is determined by using a detail thermal model, the cooling pattern is referred to as a detail cooling pattern.

In those detail thermal models employed in production of rolling materials such as high-class steel strips, there were used many parameters to make detail thermal calculations as necessary for a cooling control to be performed. Moreover, such calculations were subject to limit-exceeding states developed in the way. When trying to realize a targeted detail cooling pattern avoiding such states, calculations had to be iterated, so that the calculation load became very heavy. This constituted a difficulty to attain an optimal solution, failing to produce a rolling material with a preferable material quality, as an issue.

Embodiments described herein have been devised in view of such issues. It is an object of embodiments herein to provide a rolling material cooling control apparatus, a rolling material cooling control method, and a rolling material cooling control program each adapted to reduce the calculation load when determining a detail cooling pattern from a detail thermal model, to perform an optimal cooling control allowing for ensured achievement of a preferable material quality.

Solution

To achieve the object, according to a first aspect of embodiments of the rolling material cooling control apparatus, there is provided a rolling material cooling control apparatus including a detail thermal model memory, an influence coefficient calculator, a simple cooling pattern calculator, a detail cooling pattern calculator, and a cooling controller. The detail thermal model memory has stored detail thermal models each including a mathematical formula using parameters describing a temperature variation of a rolling material in a prescribed cooling interval. The influence coefficient calculator is configured to take a detail thermal model stored in the detail thermal model memory as a basis to calculate an influence coefficient as necessary for a control of temperature variation of the rolling material. The simple cooling pattern calculator is configured to take the influence coefficient calculated by the influence coefficient calculator as a basis to make calculation of a simple cooling pattern in a simplified form of a preferable detail cooling pattern being necessary for the rolling material to have a preferable material quality. The detail cooling pattern calculator is configured to take a combination of the simple cooling pattern given by calculation at the simple cooling pattern calculator and the detail thermal model stored in the detail thermal model memory as a basis to make calculation of a detail cooling pattern of the rolling material in the prescribed cooling interval. The cooling controller is configured to take the detail cooling pattern given by calculation at the detail cooling pattern calculator as a basis to control a cooling of the rolling material.

To achieve the object, according to a second aspect of embodiments of the rolling material cooling control apparatus, the rolling material cooling control apparatus according to the first aspect includes the simple cooling pattern calculator being configured to geometrically approximate a temperature variation of the rolling material in the prescribed cooling interval by way of an approximation of a cooling rate of the rolling material using a straight line or a polynomial expression or an exponential or logarithmic algebraic expression, to make calculation of the simple cooling pattern in the simplified form of the preferable detail cooling pattern.

To achieve the object, according to a third aspect of embodiments of the rolling material cooling control apparatus, the rolling material cooling control apparatus according to the first aspect or the second aspect includes the simple cooling pattern calculator being configured to take the influence coefficient calculated by the influence coefficient calculator as a basis to calculate simple cooling patterns for a lowest speed and a highest speed compliant with the preferable detail cooling pattern being necessary for the rolling material to have a preferable material quality, and determine for a respective parameter in the calculated simple cooling patterns whether or not a value thereof resides within a range between upper and lower limits of the respective parameter. The simple cooling pattern calculator is adapted for operations unless the value of the respective parameter in the calculated simple cooling patterns resides within the range between the upper and lower limits of the respective parameter, to follow orders of precedence of parameters in the calculated simple cooling patterns, to make a parameter correction from a parameter ranked at a lower order of precedence, calculating simple cooling patterns, until respective parameters in thus calculated simple cooling patterns have values thereof residing within ranges of upper and lower limits thereof, respectively.

To achieve the object, according to a fourth aspect of embodiments of the rolling material cooling control apparatus, the rolling material cooling control apparatus according to any one of the first aspect through the third aspect includes the detail cooling pattern calculator being configured to take values of parameters in the simple cooling pattern given by calculation at the simple cooling pattern calculator, as target values in calculation of the detail cooling pattern or initial values for calculation of the detail cooling pattern, to calculate detail cooling patterns for a lowest speed and a highest speed compliant with the preferable detail cooling pattern being necessary for the rolling material to have a preferable material quality. The detail cooling pattern calculator is adapted for operations when taking the values of parameters in the simple cooling pattern as the target values, to output detail cooling patterns calculated thereon. The detail cooling pattern calculator is adapted for operations when taking the values of parameters in the simple cooling pattern as the initial values, to determine for a respective parameter in detail cooling patterns calculated thereon whether or not a value thereof resides within a range between upper and lower limits of the respective parameter. The detail cooling pattern calculator is adapted to serve unless the value of the respective parameter in the calculated detail cooling patterns resides within the range between the upper and lower limits of the respective parameter, to follow orders of precedence of parameters in the calculated detail cooling patterns, to make a parameter correction from a parameter ranked at a lower order of precedence, calculating detail cooling patterns, until respective parameters in thus calculated detail cooling patterns have values thereof residing within ranges of upper and lower limits thereof, respectively.

To achieve the object, according to a fifth aspect of embodiments of the rolling material cooling control apparatus, the rolling material cooling control apparatus according to any one claim of the first aspect through the third aspect includes the cooling controller being adapted for operations when implementing the detail cooling pattern of the rolling material in a form of a three-staged cooling pattern through three stages being a water-cooled first cooling interval, an air-cooled second cooling interval, and a water-cooled third cooling interval, to always keep on a valve at a downstream end of the first cooling interval, securing an air-cooling time as the second cooling interval, to simply correct a position of a valve to be turned on at an upstream end of the third cooling interval.

To achieve the object, according to a sixth aspect of embodiments of the rolling material cooling control apparatus, the rolling material cooling control apparatus according to any one of the first aspect through the third aspect includes the cooling controller being adapted for operations when a preferable cooling rate is higher in an order of precedence than a preferable temperature to be given to realize a preferable material quality of the rolling material, to feed back a deviation between a target temperature and a measured temperature, to add to the target temperature, to set as an internal temperature target value, and control a cooling of the rolling material to attain the internal temperature target value.

To achieve the object, according to a first aspect of embodiments of the rolling material cooling control method, there is provided a rolling material cooling control method including a step of calculating an influence coefficient, a step of calculating a simple cooling pattern, a step of calculating a detail cooling pattern, and a step of controlling a cooling. The influence coefficient calculating step calculates an influence coefficient as necessary for a control of temperature variation of a rolling material based on a detail thermal model using a mathematical formula describing a temperature variation of the rolling material in a prescribed cooling interval provided to cool the rolling material. The simple cooling pattern calculating step takes the calculated influence coefficient as a basis to calculate a simple cooling pattern in a simplified form of a preferable detail cooling pattern being necessary for the rolling material to have a preferable material quality. The detail cooling pattern calculating step takes a combination of the calculated simple cooling pattern and the detail thermal model as a basis to calculate a detail cooling pattern of the rolling material in the prescribed cooling interval. The cooling controlling step takes the calculated detail cooling pattern as a basis to control a cooling of the rolling material.

To achieve the object, according to a first aspect of embodiments of the rolling material cooling control program, there is provided a rolling material cooling control program including, for a computer adapted to execute, a step of calculating an influence coefficient, a step of calculating a simple cooling pattern, a step of calculating a detail cooling pattern, and a step of controlling a cooling. The influence coefficient calculating step calculates an influence coefficient as necessary for a control of temperature variation of a rolling material based on a detail thermal model using a mathematical formula describing a temperature variation of the rolling material in a prescribed cooling interval provided to cool the rolling material. The simple cooling pattern calculating step takes the calculated influence coefficient as a basis to calculate a simple cooling pattern in a simplified form of a preferable detail cooling pattern being necessary for the rolling material to have a preferable material quality. The detail cooling pattern calculating step takes a combination of the calculated simple cooling pattern and the detail thermal model as a basis to calculate a detail cooling pattern of the rolling material in the prescribed cooling interval. The cooling controlling step takes the calculated detail cooling pattern as a basis to control a cooling of the rolling material.

Advantageous Effects

As will be seen from the foregoing, according to embodiments herein, there are provided rolling material cooling control apparatuses, rolling material cooling control methods, and rolling material cooling control programs each adapted to implement calculation of an influence coefficient, calculation of a simple cooling pattern, calculation of a detail cooling pattern, and control of a cooling. The influence coefficient calculation is made to calculate an influence coefficient as necessary for a control of temperature variation of a rolling material based on a detail thermal model using a mathematical formula describing a temperature variation of the rolling material in a prescribed cooling interval provided to cool the rolling material. This influence coefficient is taken as a basis for the simple cooling pattern calculation to calculate a simple cooling pattern in a simplified form of a preferable detail cooling pattern being necessary for the rolling material to have a preferable material quality (such as strength or ductility). The calculated simple cooling pattern is taken in combination with the detail thermal model as a basis for the detail cooling pattern calculation to calculate a detail cooling pattern of the rolling material in the prescribed cooling interval. The calculated detail cooling pattern is taken as a basis for the cooling control to control a cooling of the rolling material. It will be seen that according to embodiments herein, in comparison with using a detail thermal model to directly determine a detail cooling pattern, the calculation load can be reduced when determining a detail cooling pattern from the detail thermal model. This affords to perform an optimal cooling control, allowing for an efficient control of material quality as necessary for production of high-class steel strips or the like.

DESCRIPTION OF EMBODIMENTS

Figure 1:
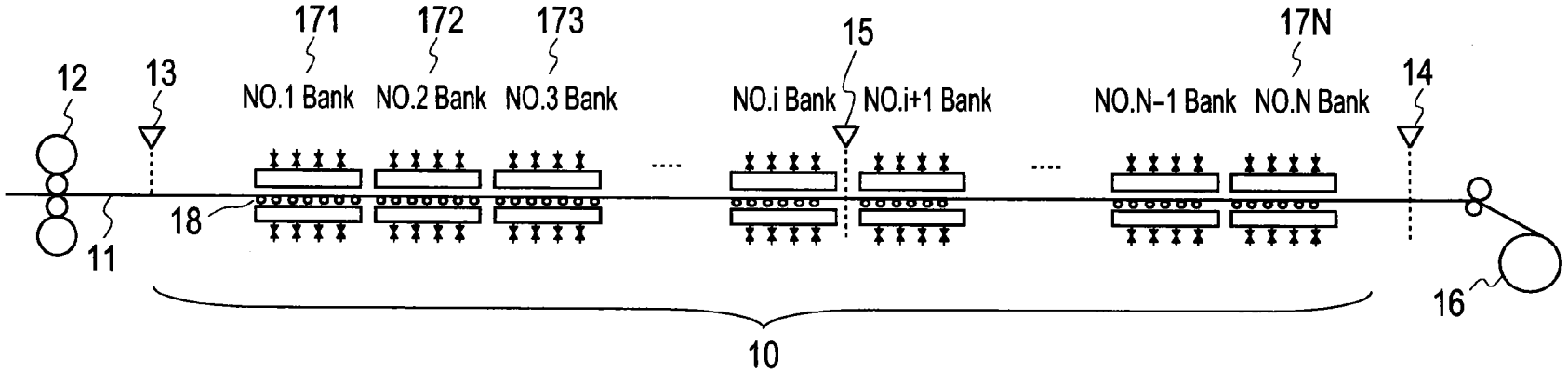
FIG. 1 is an illustration showing an example of transfer table provided with cooling banks in a hot strip rolling line constituting an object of application of rolling material cooling control apparatuses according to examples of embodiments.

There will be described rolling material cooling control apparatuses according to embodiments herein, with reference to drawings. For the sake of convenience in description, rolling material cooling control apparatuses according to examples of embodiments are adapted to serve for objects of control to be hot strip rolling lines involving cooling equipment as will be described with reference to FIG. 1 and FIG. 2. It however is noted that they are likewise applicable also to rolling installations of other forms such as plate rolling lines and cold rolling lines.

<<Description of Hot Strip Rolling Lines (FIG. 1 and FIG. 2)>>

Description is now made of hot strip rolling lines constituting objects of application of rolling material cooling control apparatuses according to embodiments herein.

Hot strip rolling lines make a product quality control of rolling material involving a dimensional control of product, and a thermal control of rolling material. The dimensional control of product includes items such as a strip thickness control for controlling a strip thickness at a transversely central portion of a rolling material, a sheet width control, a sheet crown control for controlling a transverse distribution of thickness, and a flatness control for controlling a transverse extension of a rolling material.

Also, the thermal control of rolling material includes a finisher delivery temperature control for controlling a temperature at the delivery of a finisher, and a coiling temperature control for controlling a temperature in front of a coiler.

Generally, hot strip rolling lines have a re-healing furnace, a roughing line, a finisher, a so-called run out table (ROT) as a transfer table provided with cooling banks, and a coiler installed in this order. Typically, rolling materials have temperatures ranging 1200 to 1250 degrees C. at the delivery of the re-heating furnace, 1100 to 1150 degrees C. at the delivery of the roughing line, 1050 to 1100 degrees C. at the entry of the finisher, 850 to 900 degrees C. at the delivery of the finisher, and 150 to 700 degrees C. in front of the coiler.

Materials have their material qualities such as those of strength or ductility, which are significantly susceptive to conditions they undergo at the finisher, such as deformation amounts and temperatures, and besides, to the cooling in the way after leaving the finisher to the coiler. Therefore, the coiling temperature control being made between the finisher and the coiler is very important to make up a material quality.

It is noted that the terms 'product quality' and 'material quality' have their senses. As used herein, the product quality refers to items including the thickness, width, sheet crown, flatness, and temperature. The material quality refers to the strength, ductility, or such.

For general steels, the coiling temperature resides within a range of 150 to 700 degrees C., as described, and in most cases, cooling patterns employed include an early stage cooling pattern, a latter stage cooling pattern, and a moderate cooling pattern. The early stage cooling pattern applies water injection for a cooling at a front stage of the transfer table (ROT). The latter stage cooling pattern applies water injection for a cooling at a rear stage of the transfer table (ROT). The moderate cooling pattern makes a gradual cooling on an intermediate stage of the transfer table (ROT).

On the other hand, there is a manner of cooling employed in production of high-class steels and special steels, such as dual phase steels that have two layers including a ferrite and a martensite being steel structures, and TRIP steels that have a residual austenite. This cooling is made through three stages being a (water-cooled) first cooling interval, a (air-cooled) second cooling interval, and a (water-cooled) third cooling interval, so this is called a three-staged cooling pattern. In this case, the coiling temperature resides within a range of 150 to 350 degrees C. The three-staged cooling pattern includes two water-cooled intervals being the first cooling interval and the third cooling interval, which are given target values of cooling rates, and required to keep up the target values.

FIG. 1 is an explanatory diagram showing examples of equipment configurations such as those on a transfer table (ROT) 10 in a hot strip rolling line.

In FIG. 1, the transfer table (ROT) 10 is an installation for cooling a rolling material 11, transferring from a rolling mill final stand 12 of a rolling mill, typically of a finisher, to a coiler 16. There is a finisher delivery temperature pyrometer (FDT) 13 installed at the delivery side of the rolling mill final stand 12 of the finisher that is most upstream of the transfer table (ROT) 10. On the other hand, a coiling temperature pyrometer (CT) 14 is installed in a front stage of the coiler 16 that is most downstream of the transfer table (ROT) 10. There may be intermediate temperature pyrometer (MT) 15 installed at arbitrary locations on the transfer table (ROT) 10. The number of intermediate temperature pyrometer (MT) 15 and locations of their installation may vary in accordance with the transfer table (ROT) 10 and the rolling line.

As shown in FIG. 1, the rolling material 11 leaving the rolling mill final stand 12 has a temperature measured by the finisher delivery temperature pyrometer (FDT) 13, and is exposed to cooling water sprayed at n (n=1 to N, a typical N residing between 7 and 25) cooling banks 17*n*, that is, at cooling banks 171, 172, . . . , 17N, whereby the rolling material 11 is cooled. After that, it has a temperature measured by the coiling temperature pyrometer (CT) 14, and is coiled by the coiler 16. Typically, the transfer table (ROT) 10 has an array of multiple rolls 18 operable to rotate for transfer of the rolling material 11.

Figure 2:
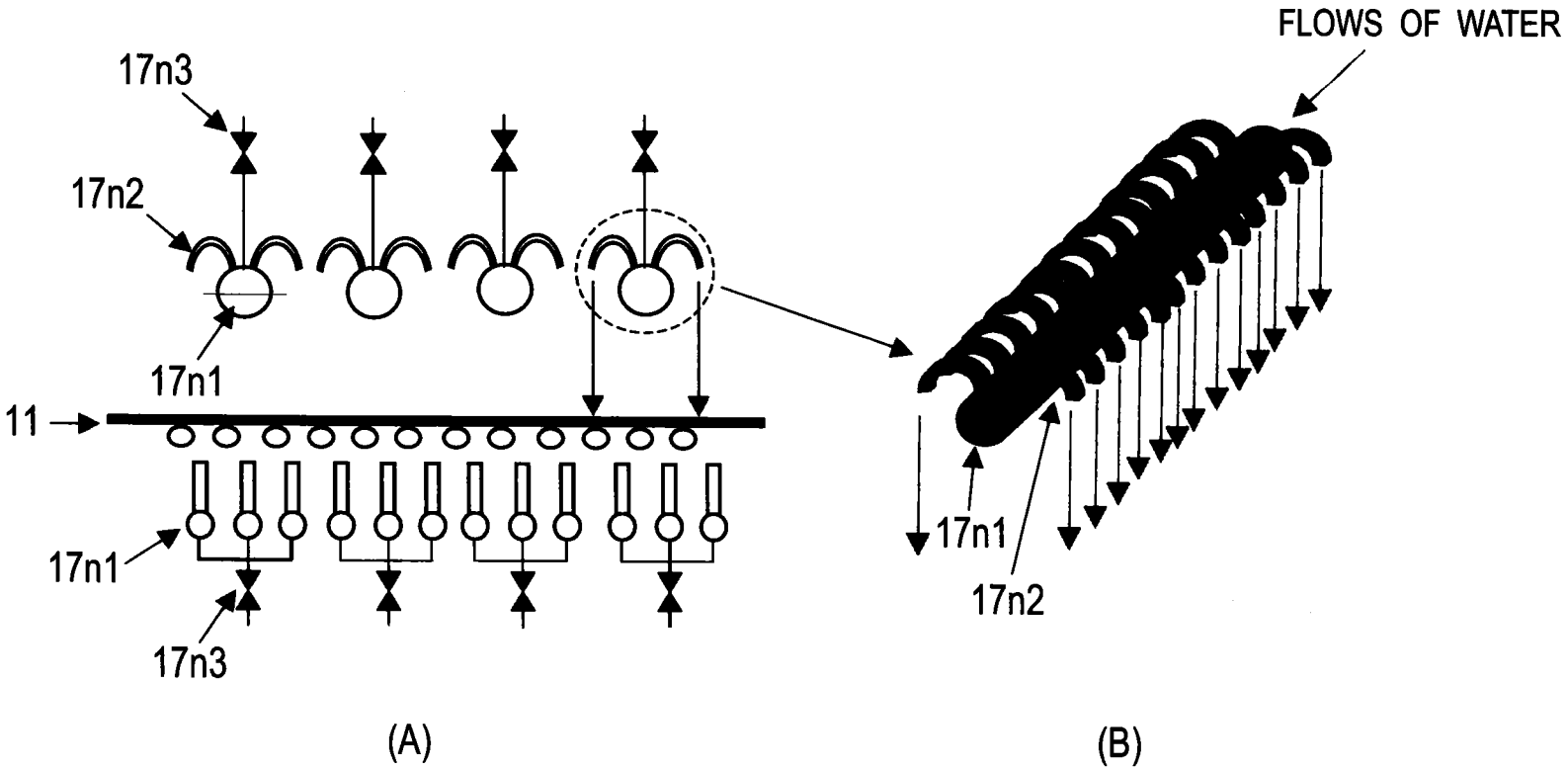
FIG. 2 is an illustration showing an example of cooling bank in the hot strip rolling line constituting an object of application of rolling material cooling control apparatuses according to examples of embodiments.

FIG. 2 is an explanatory diagram showing an example of equipment configuration of a cooling bank 17*n* on the transfer table (ROT) 10.

As shown in FIG. 2, one cooling bank 17*n* typically has upper and lower arrays of headers 17*n*1 ranging 4 to 12 or near in number (see FIG. 2(A) illustrating 4 upper headers and 12 lower headers). Each header 17*n*1 has sets of nozzles 17*n*2 arrayed in the transfer direction of rolling material, at both sides thereof, or in a direction perpendicular to the transfer direction, as illustrated in FIG. 2(B).

Further, each header 17*n*1 is provided with a valve 17*n*3. This valve 17*n*3 is on/off operable to adjust the flow rate of cooling water. In some cases, as shown under the transfer table (ROT) 10 in FIG. 2(A), sub-arrays of headers 17*n*1 are each controlled with a single valve 17*n*3. Valves 17*n*3 are connected through pipes to a source that is a water storage tank (un-depicted) installed at a higher place. The water storage tank (un-depicted) thus has differences in level to headers 17*n*1, which determine the momentum of cooling water colliding on surfaces of the rolling material 11.

It is noted that there may be cooling banks provided with valves 17*n*3 each operable for continuous adjustment of flow rate or adapted to use pressures of cooling water increased at the source to intensify the momentum of collision of cooling water, instead of using cooling water free-falling to collide on metal surfaces as described.

Here, it is tried to make the momentum of collision of cooling water as greater as possible. When cooling water is injected to a hot object, vapor films are formed between the hot object and water, turning down the cooling effect of water. Such vapor films should be broken, for injecting water directly onto metal surfaces to enhance the cooling effect, this being the reason why those trials are made.

At any valve 17*n*3, there is a delay of time elapsed after the valve 17*n*3 is given an off/off command or a flow rate command, before the valve 17*n*3 actually starts or stops water injection or until an actual result value of flow rate from the valve 17*n*3 reaches a commanded value. Therefore, valves 17*n*3 should be kept from frequent on/off actions, i.e., open close operations, as far as possible. This is preferable from the viewpoint of a cooling temperature control to be improved in precision.

<Configuration of Rolling Material Cooling Control Apparatus in Example 1>

Description is now made of a rolling material cooling control apparatus according to an example 1 of embodiment.

Figure 3:
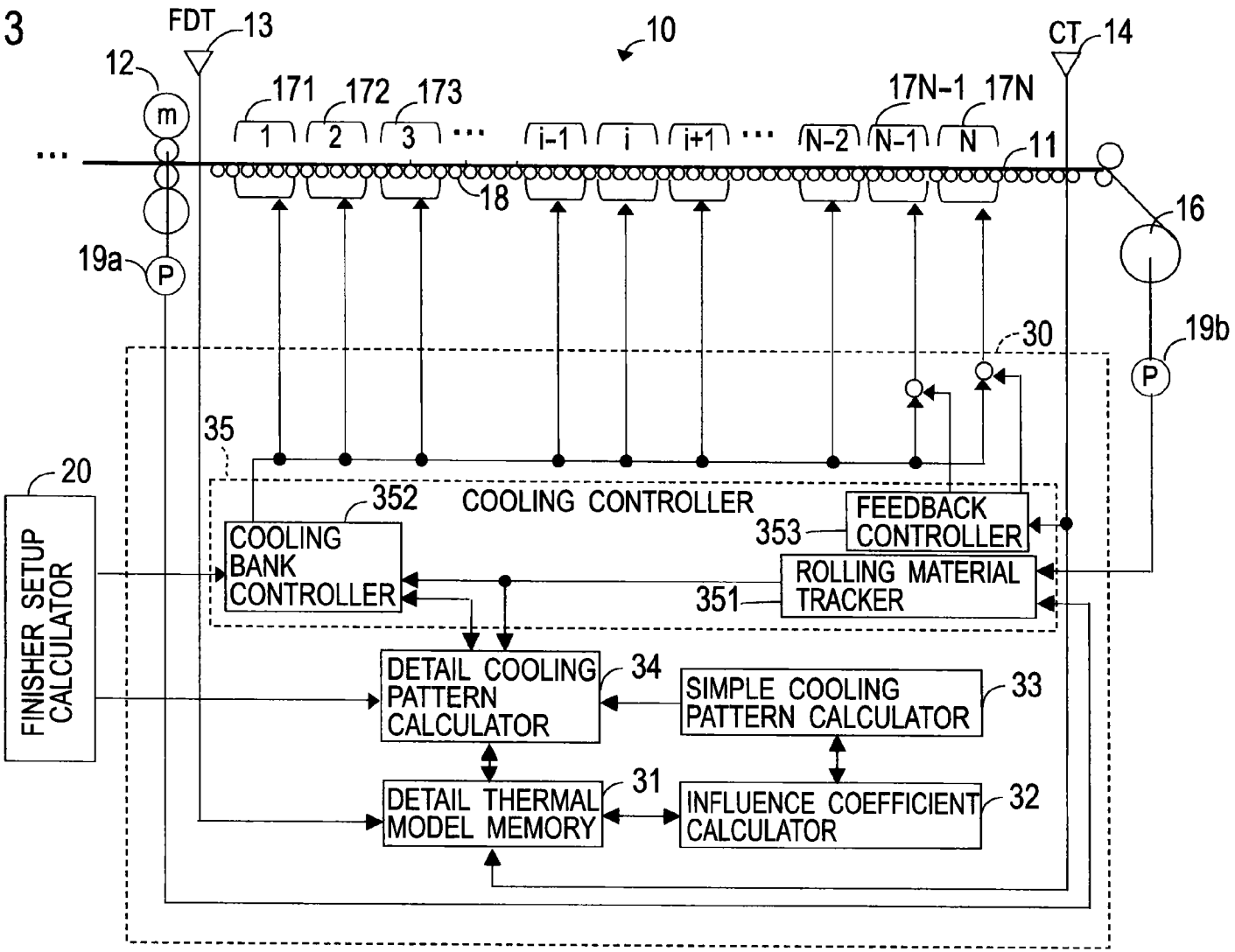
FIG. 3 is a block diagram showing an example of configuration of a rolling material cooling control apparatus according to an example 1 of embodiment.

FIG. 3 is a block diagram showing an example of configuration of the rolling material cooling control apparatus according to the example 1 of embodiment. It is noted that FIG. 3 shows a transfer table (ROT) 10, of which the configuration is similar to that of the transfer table (ROT) 10 shown in FIG. 1, so description is omitted.

As shown in FIG. 3, the rolling material cooling control apparatus 30 according to the example 1 of embodiment includes a detail thermal model memory 31, an influence coefficient calculator 32, a simple cooling pattern calculator 33, a detail cooling pattern calculator 34, and a cooling controller 35.

The detail thermal model memory 31 has stored detail thermal models each including a mathematical formula using parameters describing a temperature variation of a rolling material in a prescribed cooling interval that is provided for cooling a rolling material rolled in a hot strip rolling line. Here, in the example 1, the prescribed cooling interval provided for cooling a rolling material is set as a cooling interval extending e.g. from a finisher delivery temperature pyrometer (FDT) 13 to a coiling temperature pyrometer (CT) 14, over the transfer table (ROT) 10. It however is noted that this is in no way restrictive. The detail thermal model as well as parameters will be described later on.

The influence coefficient calculator 32 is operable to take any detail thermal model stored in the detail thermal model memory 31 as a basis to calculate influence coefficients as necessary for a control of temperature variation of a rolling material 11.

The simple cooling pattern calculator 33 is operable to take an influence coefficient calculated by the influence coefficient calculator 32 as a basis to make calculation of a simple cooling pattern in a simplified form of a preferable detail cooling pattern being necessary for the rolling material 11 to have a preferable material quality. In the example 1, the simple cooling pattern calculator 33 is operable to geometrically approximate a temperature variation of the rolling material 11 in the prescribed cooling interval by way of an approximation of a cooling rate of the rolling material 11 using a straight line or a polynomial expression or an exponential or logarithmic algebraic expression, to make calculation of an approximated simple cooling pattern in a simplified form of the preferable detail cooling pattern. The cooling rate of the rolling material 11 may be approximated as a cooling rate in a cooling interval extending e.g. from the finisher delivery temperature pyrometer (FDT) 13 to the coiling temperature pyrometer (CT) 14, over the transfer table (ROT) 10.

The detail cooling pattern calculator 34 is operable to take a combination of the simple cooling pattern given by calculation at the simple cooling pattern calculator 33 and a detail thermal model stored in the detail thermal model memory 31 as a basis to make calculation of a detail cooling pattern of the rolling material 11 in the prescribed cooling interval that is the cooling interval extending from the finisher delivery temperature pyrometer (FDT) 13 to the coiling temperature pyrometer (CT) 14.

The cooling controller 35 is operable to take the detail cooling pattern given by calculation at the detail cooling pattern calculator 34 as a basis for sending on/off operation signals (as open-close operation signals), such as those to respective valves **17*n*3, to control a cooling of the rolling material 11 in the prescribed cooling interval being the cooling interval extending from the finisher delivery temperature pyrometer (FDT) 13 to the coiling temperature pyrometer (CT) 14. The cooling controller 35 includes a rolling material tracker 351, a cooling bank controller 352, and a feedback (FB) controller 353**.

Here, the rolling material tracker 351 is operable for using signals of pulse generators **19*a* and 19*b* provided at locations including a rolling mill final stand 12 and a coiler 16, to make a positional tracking of the rolling material 11, to output tracking signals thereof to the cooling bank controller 352 and the like. It is noted that the tracking of a rolling material may not simply be by counts at the pulse generators 19*a* and 19*b*, but may also be done in any other manner, such as using material perceivable sensors. There may well be an additional location of provision midway in length of the transfer table (ROT) 10**.

The cooling bank controller 352 is operable to send on/off (open-close) operation signals, such as those to valves **17*n*3 at respective cooling banks 17*n*, based on a combination of a tracking signal that is given from the rolling material tracker 351 and represents a position of the rolling material 11, and a detail cooling pattern that is calculated on a detail thermal model at the detail cooling pattern calculator 34**.

The feedback (FB) controller 353 is operable to evaluate a deviation between a target value and an actual measured value of coiling temperature at the coiling temperature pyrometer (CT) 14 for each strip segment, and output commands for water injection to feedback (FB)-controlling cooling banks near to the coiling temperature pyrometer (CT) 14, for instance, to N-1-th and Nth cooling banks 17N-1 and 17N. It is noted that the feedback (FB) controller 353 is arbitrary in configuration, and may well be omitted.

<Outline of Operations in Example 1>

Description is now made of outline of operations of the rolling material cooling control apparatus 30 according to the example 1 configured as described above.

The rolling material cooling control apparatus 30 according to the example 1 first operates to acquire, from a finisher setup calculator 20, pieces of information such as predictive temperature values of a rolling material at the finisher delivery temperature pyrometer DT) 13 as well as speed patterns of the rolling material at the finisher delivery temperature pyrometer (FDT) 13.

Then, in the rolling material cooling control apparatus 30 according to the example 1, the cooling bank controller 352 of the cooling controller 35 operates to send control signals to cooling banks **17*n* on the transfer table (ROT) 10, thereby making setups on control information such as flow rates to be outlet at valves 17*n*3, or on/off information of valves 17*n*3, as they are calculated at the cooling bank controller 352. It is now assumed for the simplicity that those valves 17*n*3 installed as targets of control at the cooling banks 17*n* are open-close valves to be controlled by on/off information of the valves 17*n*3**. It is noted that even for flow control valves to be controlled by control information such as flow rates, the concept is identical.

Here, the rolling material tracker 351 of the cooling controller 35 makes a positional tracking of a rolling material 11 using pulse signals input from the pulse generators **19*a* and 19*b* provided at locations including the rolling mill final stand 12 and the coiler 16**.

In the rolling material cooling control apparatus 30 according to the example 1, this is made as follows. Like the coiling temperature control method in the past, the rolling material 11 is assumed as a series of connected parts of a fixed length called strip segments (as cooling control units), and divided into strip segments (as cooling control units), for tracking a position of rolling material for each strip segment to control a temperature every strip segment.

Then, in the rolling material cooling control apparatus 30 according to the example 1, the cooling bank controller 352 of the cooling controller 35 is given from the rolling material tracker 35 a piece of tracking information representing a position of rolling material every strip segment. The cooling bank controller 352 takes the tracking information as a basis to determine for a respective strip segment (as a cooling control unit) which valves **17*n*3 at which cooling banks 17*n* should be turned on or off, as the strip segment travels, passing under the finisher delivery temperature pyrometer (FDT) 13, till it arrives at the coiling temperature pyrometer (CT) 14. Also in embodiments herein, the concept of dividing a rolling material 11** into strip divisions to control a temperature of each strip segment is same as before.

The cooling bank controller 352 makes its initial setup calculations as operations to determine which valves **17*n*3 are to be turned on (open), as a first strip segment that is a strip segment of No.=1 travels from the finisher delivery temperature pyrometer (FDT) 13 to the coiling temperature pyrometer (CT) 14. This determination is made by using e.g. predictive values of finisher delivery temperatures given as information from the finisher setup calculator 20, on the basis of a detail cooling pattern calculated by the detail cooling pattern calculator 34**.

More specifically, the cooling bank controller 352 takes the detail cooling pattern calculated by the detail cooling pattern calculator 34 as a basis to determine orders of precedence to turn on (open) valves **17*n*3**, and repeat trying on/off operations following the orders of precedence until a preferable coiling temperature is attained.

After initial setup calculations to determine which valves **17*n*3 are to be turned on or off for the first (No.=1) strip segment, the cooling bank controller 352 enters a so-called dynamic control. In this control, the cooling bank controller 352 operates each time when the next or sequential strip segment that is a strip segment of No.=2 or sequential passes the finisher delivery temperature pyrometer (FDT) 13, to take a finisher delivery temperature measured by the finisher delivery temperature pyrometer (FDT) 13 as a basis to apply to this strip segment calculations similar to the initial setup calculations, to thereby determine which valves 17*n*3** are to be turned on or off. For the initial setup calculations as well as for the dynamic control, detail processes will be described later on.

The rolling material tracker 351 uses pulse signals from the pulse generators 19*a* and 19*b* as a basis to make a positional tracking of a strip segment for initial setup calculations and dynamic control. When the strip segment has come up to a position for a valve of a cooling bank 17*n* to be turned on or off, the rolling material tracker 351 sends a positional detection signal to the cooling bank controller 352, whereby the cooling bank controller 352 is operable to turn on or off the valve of the cooling bank 17*n* in an appropriate manner.

And, the coiling temperature pyrometer (CT) 14 is operable when having measured a coiling temperature every strip segment, for evaluation of a deviation between a target coiling temperature and the measured coiling temperature to have the feedback (FB) controller 353 output commands for water injection to feedback (FB)-controlling cooling banks, for instance, to the N-1-th and N-th cooling banks 17N-1 and 17N.

Upon completion of a coiling of the length of rolling material 11 at the coiler 6, the detail thermal model memory 31 serves for collecting results of measurements such as those of temperatures of each strip segment at the finisher delivery temperature pyrometer (FDT) 13, the coiling temperature pyrometer (CT) 14, etc. It can further serve, as necessary, for learning or adaptively correcting a detail thermal model including a mathematical formula describing a temperature variation in the course over the transfer table (ROT) 10 between the finisher delivery temperature pyrometer (FDT) 13 and the coiling temperature pyrometer (CT) 14.

DETAIL OPERATIONS IN EXAMPLE 1

Description is now made of operations of the rolling material cooling control apparatus 30 according to the example 1 configured as describe above.

(Operations at Detail Thermal Model Memory 31)

The detail thermal model memory 31 has stored detail thermal models each including a mathematical formula describing a temperature variation of a rolling material 11 in a prescribed cooling interval provided for cooling the rolling material rolled in the hot strip rolling line. The prescribed cooling interval is provided along a course extending e.g. from the finisher delivery temperature pyrometer (FDT) 13 to the coiling temperature pyrometer (CT) 14, over the transfer table (ROT) 10.

More specifically, the detail thermal model memory 31 has functions provided as the detail thermal models each including a mathematical formula describing a temperature variation in the cooling interval on the transfer table (ROT) 10. There is employed e.g. a finite difference method, whereby a rolling material 11 is divided into divisions in the sheet thickness direction, and a respective divided interval in the sheet thickness direction is represented by a point, which is referred to as a node i. The functions the detail thermal model memory 31 has as the above detail thermal models each include a mathematical formula using many parameters describing a temperature variation $\Delta T_i$ at a respective node i of the rolling material 11. Those parameters are described below.

Namely, for any node number i in the rolling material 11, there is a detail thermal model of its temperature variation $\Delta T_i$ that is representative by e.g. an expression 1, such that:

[Math 1]

$$\Delta T_i = \frac{\sum Q_i}{\rho C_p V_i} \Delta t \qquad \text{(expression1)}$$

Here, in the expression 1 above, designated by a parameter $Q_i$ is a heat flow, ρ is a density, $C_p$ is a specific heat, $V_i$ is a volume of the node i, and Δt is a time variation on the transfer table (ROT) 10.

The heat flow $Q_i$ can be defined by an expression 2 below or an expression 3 below, whichever is applicable to the node that may be exposed at a surface of the rolling material 11 or reside inside the rolling material. For nodes, description will be made with reference to FIG. 4.

First, for any node at a surface of the rolling material, the heat flow balance can be represented by the expression 2, such that:

[Math 2]

$$\Sigma Q_i = -Q_{rad} - Q_{water} - Q_{air} - Q_{i_to_i+1}^{cond} + Q_{transf} \qquad \text{(expression2)}$$

Here, in the expression 2 above, designated by a parameter $Q_{rad}$ is a heat flow by radiation, $Q_{water}$ is a heat flow by water-cooling heat transfer, $Q_{air}$ is a heat flow by air-cooling heat transfer convection, $$Q_{i_to_i+1}^{cond}$$

is a heat transfer from the node i to a node (i+1), and $Q_{Transf}$ is a heat flow by phase deformation. Further, indicated by a prefix "−" is a lose of heat, and "+" is a generation of heat.

Next, for any node inside the rolling material 11, the heat flow balance can be represented by the expression 3 in which parameters have similar meanings to the expression 2, such that:

[Math 3]

$$\Sigma Q_i = -Q_{i_to_i+1}^{cond} + Q_{i-1_to_i}^{cond} + Q_{transf} \qquad \text{(expression3)}$$

It is noted that in the (expression2) as well as in the (expression 3), definitions of radiation, heat transfer, and heat convention are each made by using a general expression of thermodynamics.

Figure 4:
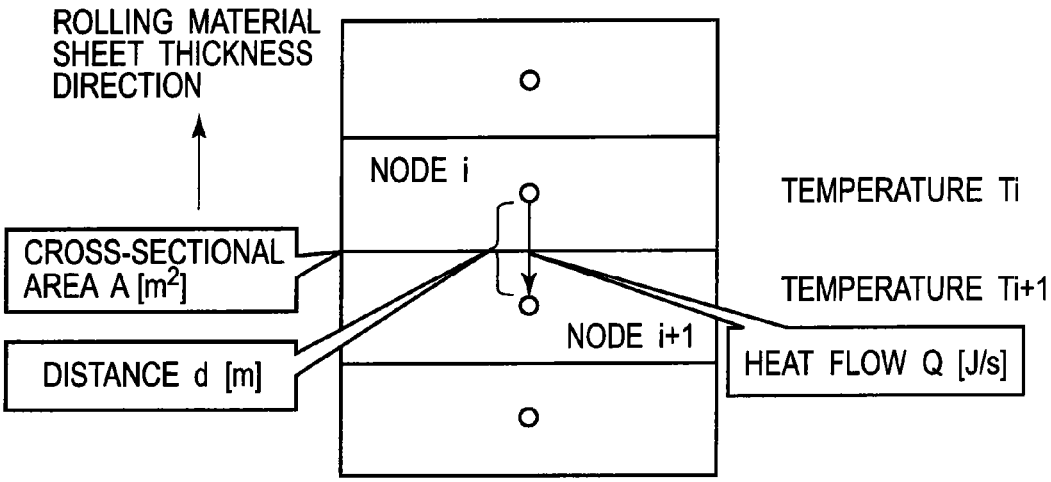
FIG. 4 is an explanatory diagram describing nodes in a rolling material.

FIG. 4 is an explanatory diagram showing an example of temperature distribution in the sheet thickness direction of a rolling material 11.

FIG. 4 shows an example in which the rolling material 11 is divided into four divisions in its sheet thickness direction, for instance, and a respective one thereof is represented by a point referred to as a node i (i=1 to 4), for use to calculate heat transfer between nodes i. FIG. 4 illustrates the heat transfer between nodes as that from a node i to a node (i+1) employing a common practice.

In FIG. 4, the rolling material 11 has a flow of heat in the sheet thickness direction, which can be represented in a continuous system by a relational expression, such that:

[Math 4]

$$Q = -kA \frac{\partial T}{\partial x} \qquad \text{(expression4)}$$

Here, symbols have their meanings, as follows. Also examples of units are shown.

Q: heat flow per unit time [J/s]

k: heat conductivity [J/(msK)]

A: area [$m^2$]

T: temperature of rolling material [degC]

X: position in the sheet thickness direction of rolling material

Here, it is given in such a form as shown by the expression 4, as an example of representation using many parameters denoted by the symbols.

In a representation using a difference equation, it can be given as shown below by an expression 5 using parameters denoted below by symbols, such that:

[Math 5]

$$Q_{i\to i+1} = \frac{kA_{i\to i+1}(T_i - T_{i+1})}{d} \quad \text{(expression5)}$$

$Q_{i\to i+1}$: heat flow from the node i to the node (i+1) [J/s]

k: heat conductivity [J/(msK)]

$A_{i\to i+1}$: cross-sectional area between the node i and the node (i+1) [$m^2$]

$T_i$: temperature at the node i [degC]

d: distance between nodes [m]

It is noted that for the solution of difference equation there may be use of a common practice. In FIG. 4, the number of nodes in the sheet thickness direction of a rolling material is set to four, which is an example. As usual, given a strip thickness, the more the number of nodes i is set, the better precision the result of calculation has. However, too many nodes i give no more than increased calculation loads with slowed enhancements in precision. In this regard, there is a need to examine in advance the number of nodes i to be selected. As to nodes of rolling material 11, there is a disclosure in WO2008/012881 or such.

(Operations of Influence Coefficient Calculator 32)

The influence coefficient calculator 32 is operable to take a detail thermal model represented by a mathematical formula using parameters in the detail thermal model memory 31, as a basis to calculate influence coefficients as necessary for a control of temperature variation of a rolling material 11.

More specifically, there is a method of calculating a coefficient of an influence that a variable X has to a variable Y. Assuming the variable Y as a function Y(X) of the variable X, the calculation method can be represented by an expression 6 below, such that:

[Math 6]

$$\frac{\partial Y}{\partial X} = \frac{Y(X+\Delta X) - Y(X-\Delta X)}{2\Delta X} \quad \text{(expression6)}$$

Here, the function Y(X) is not any simple linear function, but is that of a complex detail thermal model defined by a mathematical formula that has many unknown parameters collected in a set, like the expression 1 above. The variable X represents a respective parameter.

Namely, the coefficient of influence defined above by the expression 6 is to be calculated in a numerical computation to show how much the Y being a function of a detail thermal model varies when the variable X being a respective parameter makes a minimal (2ΔX) change. In other words, the influence coefficient defined by the expression 6 is derived as a result of a differentiation of a function Y(X) of the expression 1 representing a detail thermal model defined by a set of parameters, as the differentiation is partially made with respect the X being a respective parameter.

(Operations of Simple Cooling Pattern Calculator 33)

Then, the simple cooling pattern calculator 33 is operable to take influence coefficients calculated by the influence coefficient calculator 32 as bases to make calculation of a simple cooling pattern in a simplified form of a detail cooling pattern that is necessary for a rolling material to have a preferable material quality (such as strength or ductility).

More specifically, the simple cooling pattern calculator 33 makes calculations for approximation of a detail cooling pattern to provide such a simple cooling pattern as illustrated in any one of FIG. 5 through FIG. 8. For the approximation, there may be use of straight lines, exponential functions or such.

Figure 5:
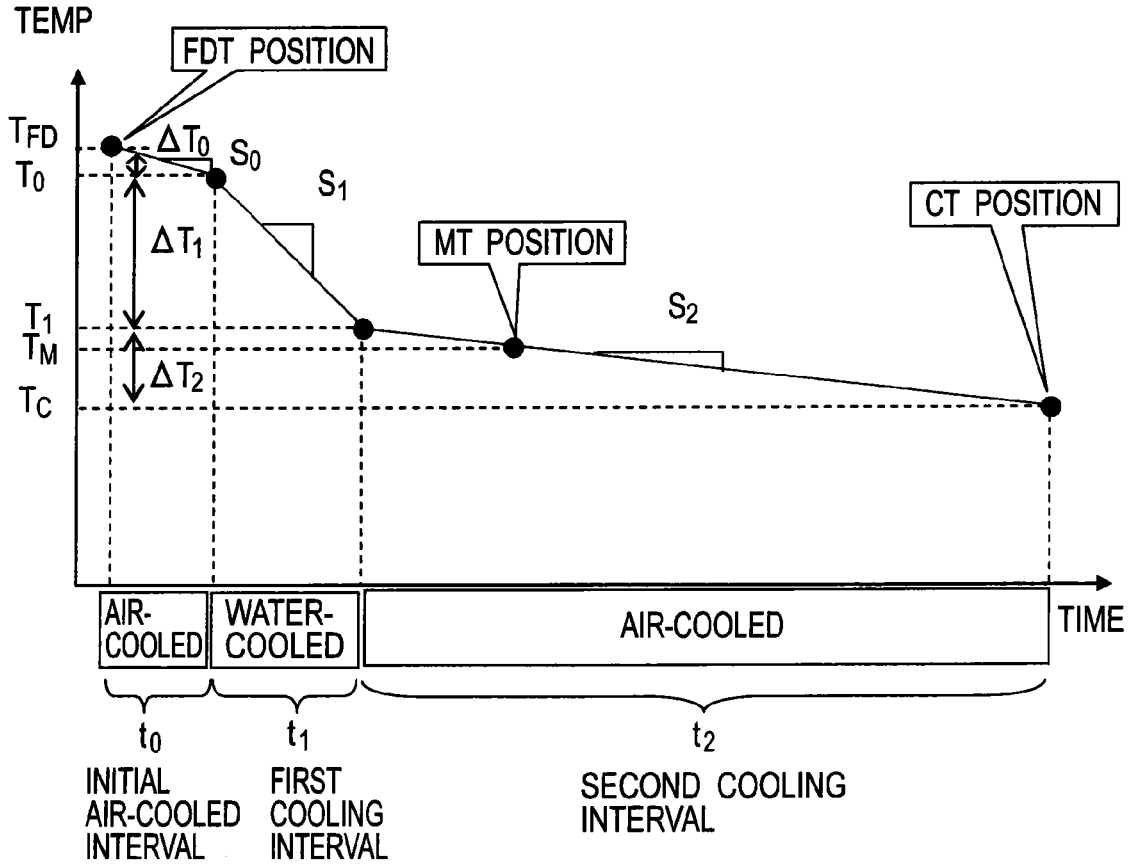
FIG. 5 is an explanatory diagram approximately showing an example of early stage cooling pattern.
Figure 6:
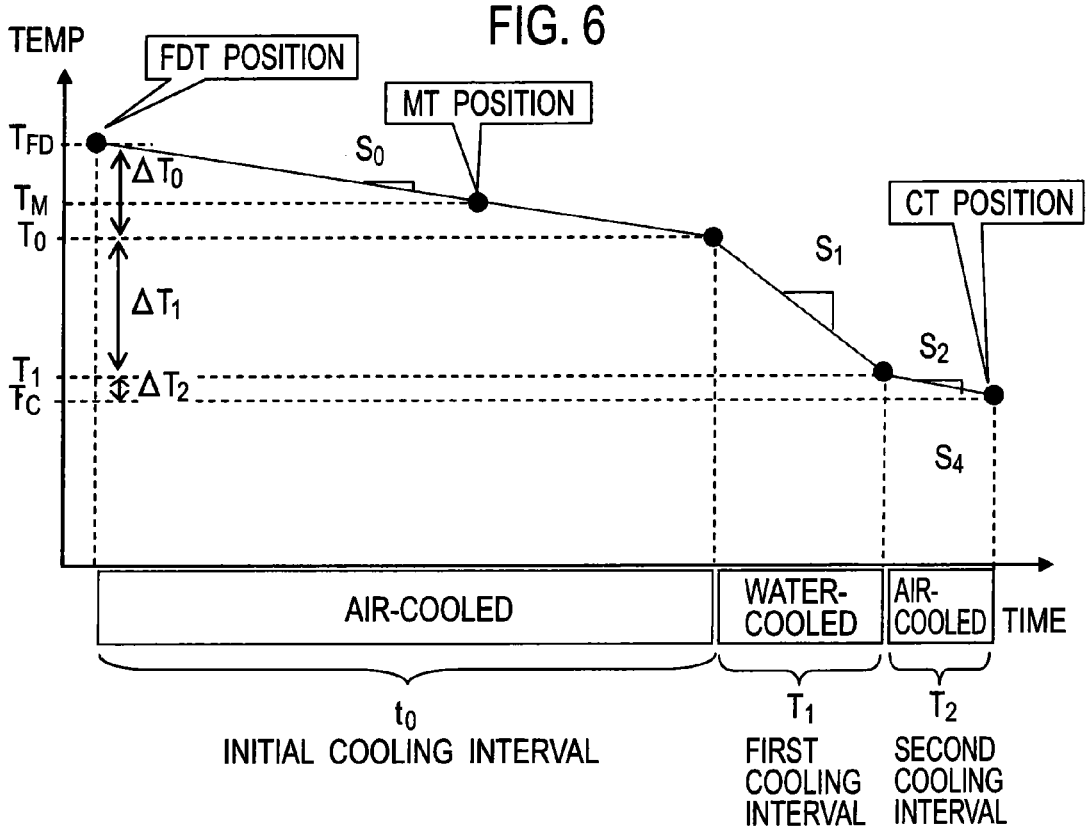
FIG. 6 is an explanatory diagram approximately showing an example of latter stage cooling pattern.
Figure 7:
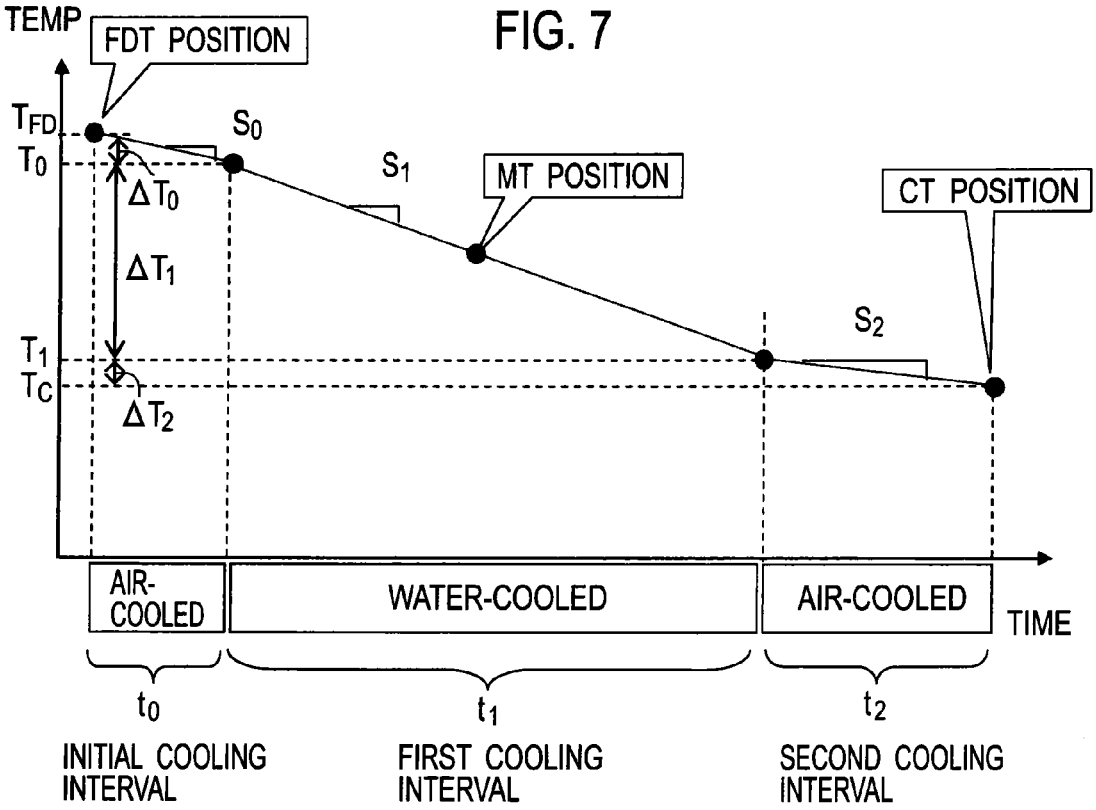
FIG. 7 is an explanatory diagram approximately showing an example of moderate cooling pattern.
Figure 8:
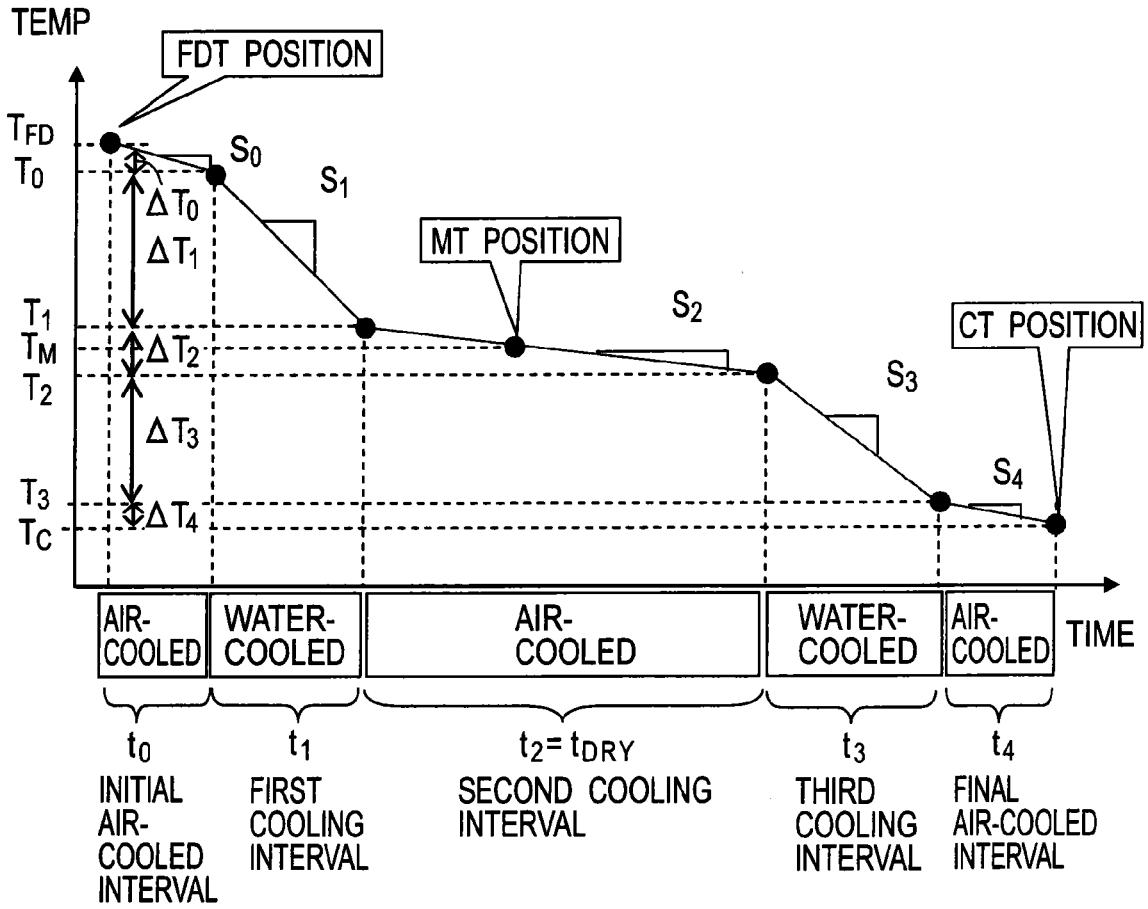
FIG. 8 is an explanatory diagram approximately showing an example of three-staged cooling pattern.

Illustrated in FIG. 5 is a simple cooling pattern for an early stage cooling, FIG. 6 is a simple cooling pattern for a latter stage cooling, FIG. 7 is a simple cooling pattern for a moderate cooling, and FIG. 8 is a simple cooling pattern for a three-staged cooling.

The simple cooling patterns in FIG. 5 through FIG. 8 each include an interval between a position to provide the finisher delivery temperature pyrometer (FDT) 13 and a position to start water cooling, which is inevitably air-cooled, so this is referred to as an initial air-cooled interval. For the three-staged cooling shown in FIG. 8, there is an interval between a valve at the most downstream cooling bank and the coiling temperature pyrometer (CT) 14, which also is inevitably air-cooled, this being referred to as a final air-cooled interval.

Further, the simple cooling patterns in FIG. 5 through FIG. 8 each have a combination of water-cooled and air-cooled intervals showing their temperature drops all approximated by straight lines. It however is noted that actual detail cooling patterns do not describe straight lines. The reason why will be discussed later on.

Further, in each of the simple cooling patterns in FIG. 5 through FIG. 8, designated at $T_{FD}$ is a finisher delivery temperature on the finisher delivery temperature pyrometer (FDT) 13, which is given a tentative value, but not always controllable at a constant value. Namely, $T_{FD}$ may vary, constituting a disturbance to the coiling temperature control.

Further, in each of FIG. 5 through FIG. 7, designated at $T_0$ is a terminal temperature of the initial air-cooled interval, $S_0$ being a cooling rate thereof, $T_1$ is a terminal temperature of a first cooling interval, $S_1$ being a cooling rate at the same, $T_C$ is a terminal temperature (as a coiling temperature) of a second cooling interval, $S_2$ being a cooling rate at the same, and $T_M$ is a temperature at a position locating an intermediate temperature pyrometer (MT). In FIG. 8, designated at $T_0$ is a terminal temperature of the initial air-cooled interval, $S_0$ being a cooling rate at the same, $T_1$ is a terminal temperature of a first cooling interval, $S_1$ being a cooling rate at the same, $T_2$ is a terminal temperature of a second cooling interval, $S_2$ being a cooling rate at the same, $T_3$ is a terminal temperature of a third cooling interval, $S_3$ being a cooling rate at the same, $T_C$ is a terminal temperature (as a coiling temperature) of the final air-cooled interval, $S_4$ being a cooling rate at the same, and $T_M$ is a temperature at a position locating an intermediate temperature pyrometer (MT).

In each of the early stage cooling pattern in FIG. 5, the latter stage cooling pattern in FIG. 6, and the moderate cooling pattern in FIG. 7, the coiling temperature ($T_c$) at the coiling temperature pyrometer (CT) 14 is given a target value as a most important target for achievement. In addition, there may be a target value specified for the cooling rate $S_1$ at the first cooling interval.

Also, for the three-staged cooling pattern shown in FIG. 8, five important parameters are used. The five important parameters in the three-staged cooling pattern shown in FIG. 8 involve the terminal temperature $T_1$ of and the cooling rate $S_1$ at the first cooling interval, a duration of time $t_2$ of the second cooling interval, the cooling rate $S_3$ at the third cooling interval, and the coiling temperature $T_C$. The five parameters have their orders of precedence determined in accordance with a material quality of a steel sheet to be produced.

Here, the three-staged cooling pattern is taken to describe as an example of most complex cooling pattern. In this example, the simple cooling pattern calculator 33 is assumed as being adapted for a straight-line approximation of a detail cooling pattern to be made in calculations to derive a simple cooling pattern. In this example, the simple cooling pattern is derived in such a form as shown in FIG. 8, while the detail cooling pattern is given as a three-staged cooling pattern in such a form as shown in FIG. 9, which will be described later on.

For calculations to derive the simple cooling pattern in such a form of three-staged cooling as shown in FIG. 8, the simple cooling pattern calculator 33 needs rough estimated values of the cooling rates $S_0$, $S_1$, $S_2$, $S_3$, and $S_4$ at the respective cooling intervals.

Figure 9:
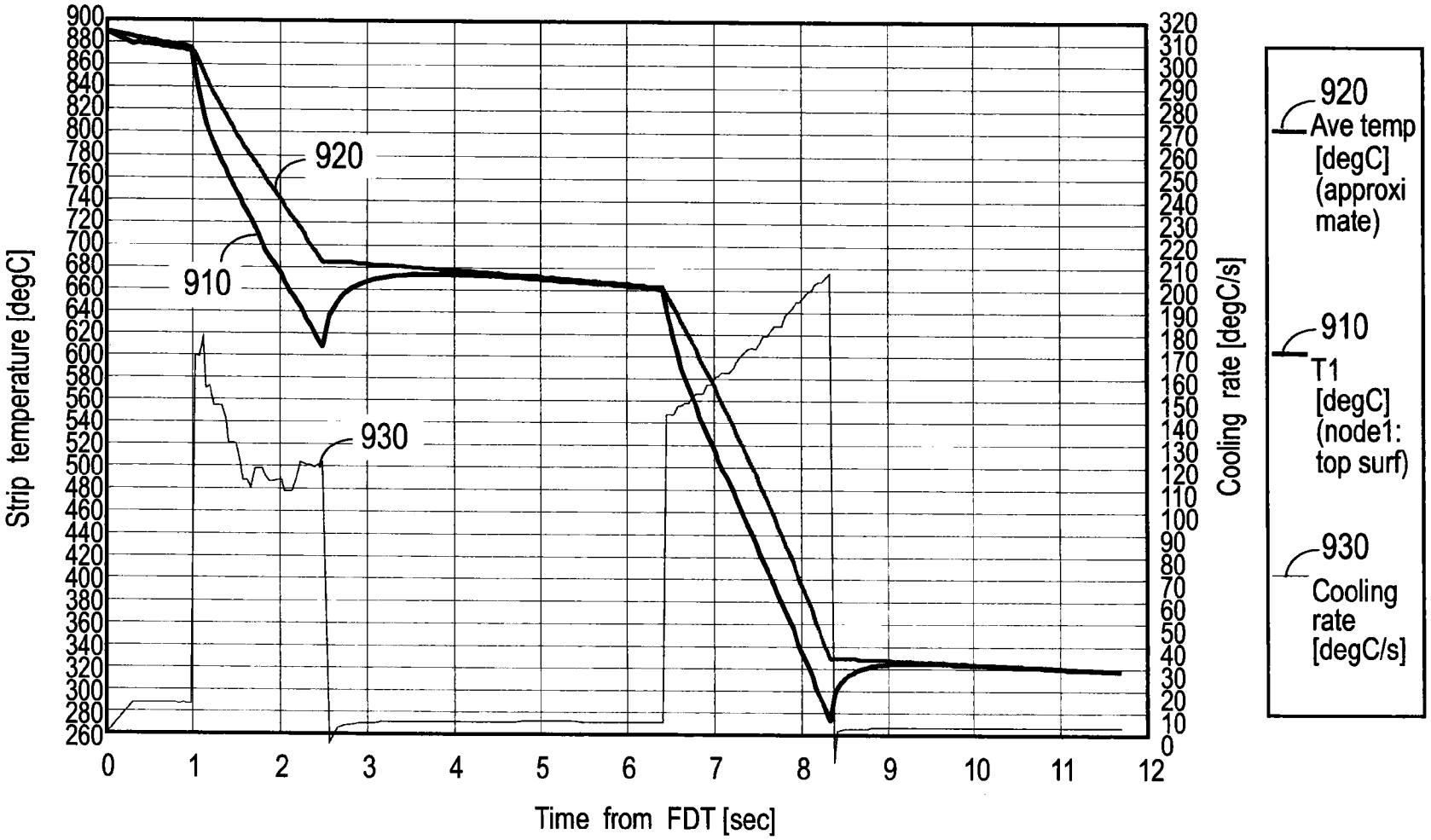
FIG. 9 is an explanatory diagram showing an example of detail cooling pattern in the form of a three-staged cooling.

FIG. 9 is an explanatory diagram showing an example of detail cooling pattern given in the form of a three-staged cooling by calculation at the detail cooling pattern calculator 34.

In FIG. 9, the horizontal axis represents a time from the finisher delivery temperature pyrometer (FDT) 13 (designated as a time from FDT [sec]), and the vertical axes represent a rolling material (strip) temperature (designated as a strip temperature [degC]) and a cooling rate (designated as a cooling rate [degC/s]).

FIG. 9 includes durations of time ranging 0 to 1 seconds, 1 to 2.5 seconds, 2.5 seconds to 6.4 seconds, 6.4 seconds to 8.3 seconds, and 8.3 seconds to 11.7 seconds, as intervals corresponding to the initial air-cooled interval $t_0$, the first cooling interval $t_1$, the second cooling interval $t_2$, the third cooling interval $t_3$, and the final (air-cooled) cooling interval $t_4$ in FIG. 8, respectively.

Further, FIG. 9 involves a polygonal line 910 showing a history of temperature at a surface of a rolling material, a polygonal line 920 showing an average temperature in the thickness direction of the rolling material, and a polygonal line 930 showing a cooling rate based on the thickness-directional average temperature of the rolling material.

Typically, the detail cooling pattern calculator 34 employs an average temperature in the thickness direction of the rolling material shown by the polygonal line 920, as a management value for cooling control.

To this end, the simple cooling pattern calculator 33 needs cooling rates $S_0$, $S_1$, $S_2$, $S_3$, and $S_4$ at the respective intervals, i.e., the initial air-cooled interval $t_0$, the first cooling interval $t_1$, the second cooling interval $t_2$, the third cooling interval $t_3$, and the final (air-cooled) cooling interval $t_4$, and inputs to use cooling rates the influence coefficient calculator 32 has calculated as influence coefficients.

Here, in the detail cooling pattern in FIG. 9, the cooling rate shown by the polygonal line 930 is changed intricately and rapidly in the first cooling interval $t_1$ at times of 1 to 2.5 seconds from the finisher delivery temperature pyrometer (FDT) 13, as well as in the third cooling interval $t_3$ at times of 6.4 to 8.3 seconds. In the first cooling interval $t_1$ and the third cooling interval $t_3$, the average temperature in the thickness direction of the rolling material shown by the polygonal line 920 has temperature drops, which also actually are intricate curves, though looking like straight lines at a glance. It is noted that if the cooling rate were constant, the temperature drops should have described straight lines.

Therefore, in an actual detail cooling pattern, some sections may need using curves such as exponential functions to make approximations such as those of the temperature history at a surface of the rolling material shown by the polygonal line 910, as well as temperature drops of the average temperature in the thickness direction of the rolling material shown by the polygonal line 920. In the simple cooling patterns in FIG. 5 through FIG. 8, they are approximated by straight lines.

In particular, when the first cooling interval $t_1$ as well as the third cooling interval $t_3$ is water-cooled, the temperature history at a surface of the rolling material shown by the polygonal line 910, as well as a temperature drop of the average temperature in the thickness direction of the rolling material shown by the polygonal line 920, tends to describe an intricate curve as illustrated by the detail cooling pattern in FIG. 9.

For this reason, the detail cooling pattern calculator 34 would have been overloaded with calculations, taking time, if it were operated for use of a detail thermal model stored in the detail thermal model memory 31 to directly calculate such a detail cooling pattern as shown in FIG. 9.

To this point, in this example of embodiment, the detail cooling pattern calculator 34 is not operated for use of any detail thermal model stored in the detail thermal model memory 31 to directly calculate such a detail cooling pattern as shown in FIG. 9. But, the detail cooling pattern calculator 34 is adapted to have the influence coefficient calculator 32 calculate influence coefficients based on a detail thermal model stored in the detail thermal model memory 31, and have the simple cooling pattern calculator 33 make calculation of a simple cooling pattern based on the influence coefficients. The detail cooling pattern calculator 34 is thus operable to refer to the simple cooling pattern given by calculation, to calculate such a detail cooling pattern as shown in FIG. 9, as it is derived from a detail thermal model stored in the detail thermal model memory 31, thereby allowing for a lightened calculation load with a shortened time when calculating a detail cooling pattern.

In this regard, the simple cooling pattern calculator 33 is assumed to simply apply e.g. linear approximations to simple cooling patterns it calculates. It is noted that there may well be included else other than linear approximations.

To do so, the simple cooling pattern calculator 33 makes e.g. such calculations as follows. Here, among the cooling patterns shown in FIG. 5 through FIG. 8, the case of most complex three-staged cooling shown in FIG. 8 is taken to describe as an example. It however is noted that also for the other cooling patterns shown in FIG. 5 through FIG. 7 similar simple cooling patterns can be calculated.

First, in FIG. 8, letting $T_{FD}$ be a temperature on the finisher delivery temperature pyrometer (FDT) 13, $T_0$ be a terminal temperature of the initial air-cooled interval $t_0$, $S_0$ be a cooling rate at the initial air-cooled interval $t_0$, $T_1$ be a terminal temperature of the first cooling interval $t_1$, $S_1$ be a cooling rate at the first cooling interval $t_1$, $T_2$ be a terminal temperature of the second cooling interval $t_2$, $S_2$ be a cooling rate at the second cooling interval $t_2$, $T_3$ be a terminal temperature of the third cooling interval $t_3$, $S_3$ be a cooling rate at the third cooling interval $t_3$, $T_{CT}$ be a terminal temperature (as a coiling temperature) of the final air-cooled interval $t_4$, and $T_M$ be a temperature at a position locating the intermediate temperature pyrometer (MT), it so follows that:

The three-staged cooling shown in FIG. 8 can be defined by basic formulae of simple cooling pattern given below, such that:

[Math 7]

$$T_0=T_{FD}-S_0t_0=T_{FD}-\Delta T_0 \quad \text{(expression7)}$$

$$T_1=T_0-S_1t_1=T_0-\Delta T_1 \quad \text{(expression8)}$$

$$T_2=T_1-S_2t_2=T_1-\Delta T_2 \quad \text{(expression9)}$$

$$T_3=T_2-S_3t_3=T_2-\Delta T_3 \quad \text{(expression10)}$$

$$T_{CT}T_3-S_4t_4=T_3-\Delta T_4 \quad \text{(expression11)}$$

$$L_{1\text{-}3}=\int_0^{+t1+t2+t3}V(\tau)d\tau \quad \text{(expression12)}$$

$$L_{0\text{-}4}=\int_0^{+t0+t1+t2+t3+t4}V(\tau)d\tau \quad \text{(expression13)}$$

Here, $L_{1\text{-}3}$ is a distance between times $t_1$ and $t_3$, and $L_{0\text{-}4}$ is a distance between times $t_0$ and $t_4$, that is, the distance from the finisher delivery temperature pyrometer (FDT) 13 to the coiling temperature pyrometer (CT) 14. V is a transfer speed of the rolling material, and τ represents clock time.

In this situation, the simple cooling pattern calculator 33 is given the five important parameters $T_1$, $T_C$, $t_2$, $S_1$, and $S_3$ as values to be achieved. Further, it is given a temperature $T_{FD}$ on the finisher delivery temperature pyrometer (FDT) 13 and a transfer speed V of the rolling material, as measurable or predictive parameters, though being variable in value. The distance $L_{0\text{-}4}$ from the finisher delivery temperature pyrometer (FDT) 13 to the coiling temperature pyrometer (CT) 14 is a fixed value.

Under such a condition, the simple cooling pattern calculator 33 calculates parameters $T_0$, $T_2$, $t_0$, $t_1$, $t_3$, $t_4$, and $L_0$, to make calculation of a simple cooling pattern.

For instance, assuming a most downstream valve of the water-cooled first cooling interval $t_1$ as being always kept on, such a geometric relation as shown in e.g. FIG. 8 can be obtained, whereby the parameters $T_0$, $T_2$, $t_0$, $t_1$, $t_3$, $t_4$, and $L_0$ are all obtainable.

However, the simple cooling pattern calculator 33 is required, when making calculation of a simple cooling pattern based on influence coefficients calculated by the influence coefficient calculator 32, to meet contents of a constraint condition such as those for a preferable material quality of the rolling material 11, e.g. a preferable strength or ductility of the rolling material 11, as well as those due to the number and locations of valves 17*n*3 at actual cooling banks 17*n*.

Therefore, as will be described later with reference to FIG. 11 and FIG. 12, the simple cooling pattern calculator 33 in this example 1 is adapted to take influence coefficients calculated by the influence coefficient calculator 32 as a basis to calculate simple cooling patterns for a lowest speed and a highest speed compliant with a preferable detail cooling pattern being necessary for the rolling material to have a preferable material quality, and determine for a respective parameter in the calculated simple cooling patterns whether or not a value thereof resides within a range between upper and lower limits of the respective parameter. Unless the value of the respective parameter in the calculated simple cooling patterns resides within the range between the upper and lower limits of the respective parameter, the simple cooling pattern calculator 33 is operable to follow orders of precedence of parameters in the calculated simple cooling patterns, to make a parameter collection from a parameter ranked at a lower order of precedence, re-calculating simple cooling patterns, until respective parameters in thus calculated simple cooling patterns have values thereof residing within ranges of upper and lower limits thereof, respectively. Those parameters may include e.g. a position the rolling material is to pass, as well as a temperature, a cooling rate, and a cooling time at the position.

Figure 10:
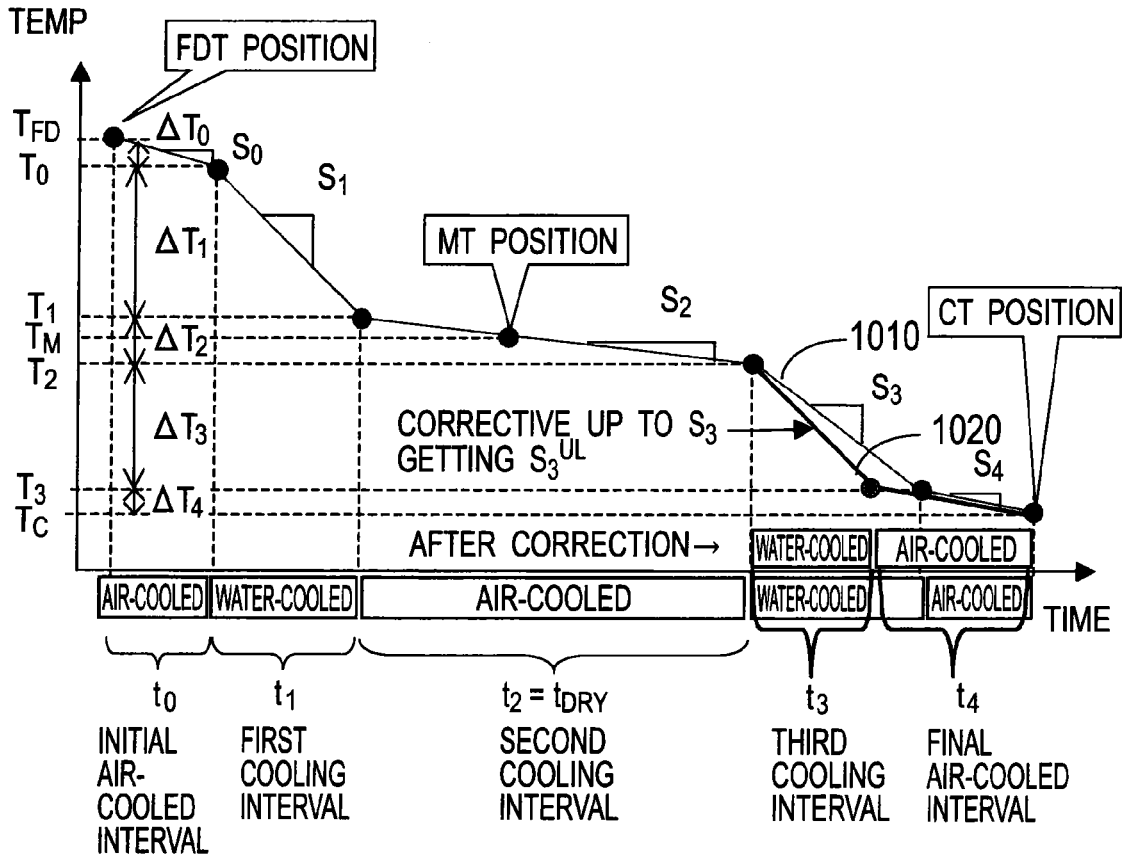
FIG. 10 is an explanatory diagram approximately showing an example of three-staged cooling pattern including a third cooling interval having a final position corrected before a most downstream of a physically actual cooling bank.

It is now assumed that such a simple cooling pattern as shown by a polygonal line 1010 in FIG. 10 is resulted from a calculation of simple cooling pattern at the simple cooling pattern calculator 33.

In that situation, a calculated third cooling interval $t_3$ has a final position, which should be located on a most downstream or upstream of the most downstream of a physically actual cooling bank, to conform to a preferable material quality of the rolling material 11, e.g. a preferable strength or ductility of the rolling material 11. Therefore, the simple cooling pattern calculator 33 needs to check whether or not the calculated simple cooling pattern meets such contents of a given constraint condition, and adjust parameters to conform to the constraint condition.

For instance, suppose a situation in which the final position of the third cooling interval $t_3$ in the calculated simple cooling pattern is located downstream of the most downstream of the physically actual cooling bank, and among the five important parameters $T_1$, $T_C$, $t_2$, $S_1$, and $S_3$, the cooling rate $S_3$ at the third cooling interval $t_3$ is ranked at a lowest order of precedence. In this situation, the simple cooling pattern calculator 33 corrects the cooling rate $S_3$ at the third cooling interval $t_3$, until this becomes a cooling rate $S_3^{UL}$ inclined to be steeper than a target value, as illustrated by a polygonal line 1020 in FIG. 10. This correction shorten the duration of time of the third cooling interval $t_3$, so that a calculated third cooling interval $t_3$ has a final position corrected to reside before the most downstream of the physically actual cooling bank 17*n*.

However, also the cooling rate $S_3$ at the third cooling interval $t_3$ has upper and lower limits to be compliant with the preferable detail cooling pattern, as well. Therefore, if the upper limit of the cooling rate $S_3$ is to be exceeded, the simple cooling pattern calculator 33 operates in advance, leaving the cooling rate $S_3$ as it is corrected e.g. up to the upper limit, to enter correction of a parameter ranked at the next lower order of precedence.

Such being the case, the simple cooling pattern calculator 33 is adapted to take influence coefficients calculated by the influence coefficient calculator 32 as a basis to make calculation of a simple cooling pattern approximated by straight lines or the like as shown in FIG. 5 through FIG. 8, to conform to contents of a constraint condition such as those for a preferable material quality, e.g. strength or ductility, of the rolling material 1, as well as those due to the number and locations of valves 17*n*3 at actual cooling banks 17*n*.

In this occasion, in order for calculations to be simplified, the simple cooling pattern calculator 33 according to this example of embodiment is operable to calculate e.g. two transfer speeds of a rolling material, as they are supposed to be a lowest speed and a highest speed of the rolling material, for use to check in advance whether or not a cooling rate as well as a cooling time or such of a preferable detail cooling pattern can be secured at each of the lowest speed and the highest speed of the rolling material. It is noted that transfer speeds of the rolling material calculated as supposed may not simply be the two cases being a lowest speed and a highest speed, but may well also be any speeds else.

(Operations of Detail Cooling Pattern Calculator 34)

Then, the detail cooling pattern calculator 34 works, while trying to turn on/off valves 17*n*3 at the actual cooling banks 17*n*, for operations to refer to detail thermal models stored in the detail thermal model memory 31, and make use of simple cooling patterns calculated by the simple cooling pattern calculator 33, as target values or initial values, to repeat calculations to provide detail cooling patterns for use to realize a preferable material quality, such as a preferable strength or ductility, of the rolling material.

Here, in the example 1, the detail cooling pattern calculator 34 is adapted to take simple cooling patterns calculated by the simple cooling pattern calculator 33, for both of using as target values and using as initial values.

When using simple cooling patterns calculated by the simple cooling pattern calculator 33 as target values, the detail cooling pattern calculator 34 is operable to check for no transfer speeds of a rolling material outreaching a lower or upper limit at either of two supposed transfer speeds being a lowest speed and a highest speed of the rolling material, before making calculations to provide detail cooling patterns, assuming that the five important parameters $T_1$, $T_C$, $t_2$, $S_1$, and $S_3$ can be realized.

In other words, when using simple cooling patterns calculated by the simple cooling pattern calculator 33 as target values, the detail cooling pattern calculator 34 is operable even if any parameter is outreaching a lower or upper limit at either of two supposed transfer speeds being a lowest speed and a highest speed of the rolling material 11, to proceed leaving that as it is, to make calculations to provide detail cooling patterns, with a conclusion to admit the detail cooling patterns even when they are not strictly achieved. By doing so, the detail cooling pattern calculator 34 is allowed to have very lightened calculation loads.

On the contrary, when using simple cooling patterns calculated by the simple cooling pattern calculator 33 as initial values, the detail cooling pattern calculator 34 is operable to determine for each of all parameters (variables) in the simple cooling patterns, whether or not the parameter is residing within a range between upper and lower limits at each of a lowest speed and a highest speed preset as the rolling material is supposed to have. If any parameter is deviating, the simple cooling pattern calculator 33 is operable to iterate calculations for correction from a parameter ranked at a lower order of precedence, so that each parameter resides within a range of upper and lower limits associated therewith. In this case, the simple cooling pattern calculator 33 has an increased calculation load relative to the case using simple cooling patterns calculated by the simple cooling pattern calculator 33 as target values. However, since the initial values are determined as necessary, it is apparent that the number of times of calculation can be reduced. In addition, it is possible to realize accurate detail cooling patterns. Here, the detail cooling pattern calculator 34 may be operable not to determine for each of all parameters (variables) in the simple cooling patterns whether or not the parameter is residing within a range between upper and lower limits at each of a lowest speed and a highest speed preset as the rolling material is supposed to have, but to determine whether or not a respective preferable value can be achieved.

It is noted that the detail cooling pattern calculator 34 executes a process of calculating detail cooling patterns when calculating initial set-points to be set up for the first No. 1 strip segment, and afterward, when making a dynamic control for each strip segment (cooling control unit), past the measurement of a finisher delivery temperature of the strip segment (cooling control unit) passing under the finisher delivery temperature pyrometer (FDT) 13.

Figure 11:
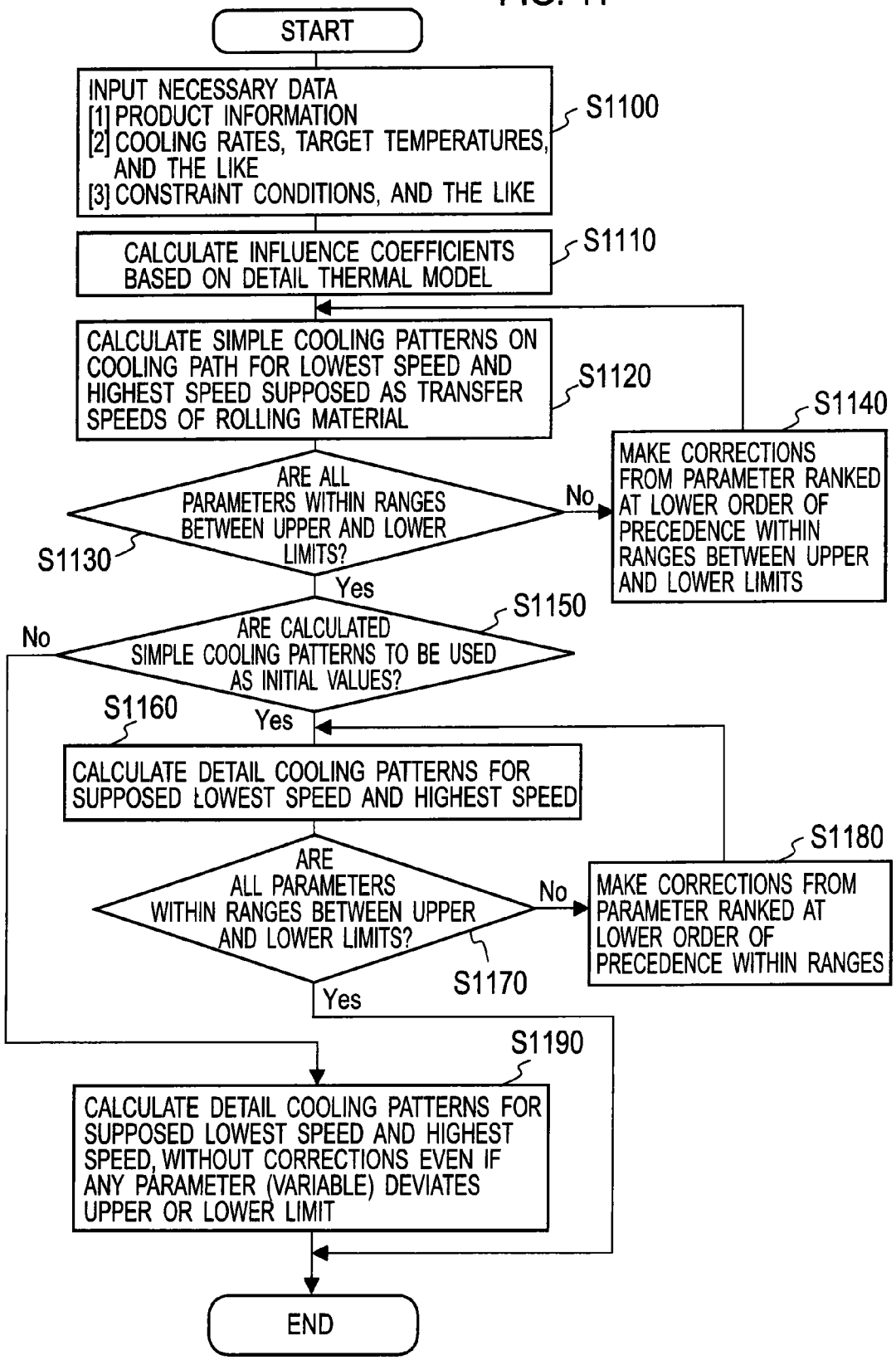
FIG. 11 is a flowchart showing an example of detail cooling pattern calculation process from a calculation of influence coefficient at an influence coefficient calculator 32 to a calculation of initial set point to be completed at a detail cooling pattern calculator 34.

FIG. 11 is a flowchart showing an example of detail cooling pattern calculation process from calculation of influence coefficients at the influence coefficient calculator 32 to completion of an initial set-point calculation of the first, i.e., No. 1 strip segment at the detail cooling pattern calculator 34.

First (at S1100), this apparatus inputs necessary data such as those from the finisher setup calculator 20, including product information pertinent to a rolling material as a target of cooling and the like, as well as cooling rates, target temperatures, constraint conditions, and the like.

Then (at S1110), the influence coefficient calculator 32 calculates influence coefficients based on a detail thermal model stored in the detail thermal model memory 31 in a described manner, to output to the simple cooling pattern calculator 33.

(At S1120) the simple cooling pattern calculator 33 takes influence coefficients calculated at S1110 by the influence coefficient calculator 32, as a basis to calculate simple cooling patterns for two cases being a lowest speed and a highest speed in transfer speed of the rolling material 11, as they are supposed for the rolling material 11 to have a preferable material quality.

Next (at S1130), the simple cooling pattern calculator 33 operates for each of the two cases being the lowest speed and the highest speed in transfer speed of the rolling material 11, to determine whether or not all parameters being variables in a simple cooling pattern calculated at S1120 reside within ranges between upper and lower limits being contents of a constraint condition to the parameters, respectively.

Here, the simple cooling pattern calculator 33 operates (at S1140) when having determined for each of the two cases being the lowest speed and the highest speed in transfer speed of the rolling material 11 that all parameters in a simple cooling pattern calculated by the simple cooling pattern calculator 33 do not reside within ranges between upper and lower limits being contents of the constraint condition to the parameters, respectively ("No" at S1130), to make corrections from a parameter ranked at a lower order of precedence, within ranges between associated upper and lower limits, and again goes to the step S1120.

Here, the parameter ranked at a lower order of precedence refers, in the cases of three-staged cooling shown in FIG. 8 through FIG. 10, any parameter else other than the above-noted five important parameters $T_1$, $T_C$, $t_2$, $S_1$, and $S_3$ being the terminal temperature $T_1$ of and the cooling rate $S_1$ at the first cooling interval, the duration of time $t_2$ of the second cooling interval, the cooling rate $S_3$ at the third cooling interval, and the coiling temperature $T_C$. For instance, it may refer to a terminal temperature $T_2$ of the second cooling interval, as well as a terminal temperature $T_3$ of the third cooling interval, a cooling rate $S_2$ at the third cooling interval $t_2$, a cooling rate $S_4$ at the final (air-cooled) cooling interval $t_4$, etc.

To the contrary, the simple cooling pattern calculator 33 operates when having determined for each of the two cases being the lowest speed and the highest speed in transfer speed of the rolling material 11 that all parameters in a calculated simple cooling pattern reside within ranges between upper and lower limits being contents of the constraint condition to the parameters, respectively ("Yes" at S1130), to output the calculated simple cooling patterns to the detail cooling pattern calculator 34.

Then (at S1150), the detail cooling pattern calculator 34 operates when using the simple cooling patterns calculated by the simple cooling pattern calculator 33, to determine which to select between using as initial values and using as target values.

Here, the detail cooling pattern calculator 34 operates when having determined to select using the simple cooling patterns calculated by the simple cooling pattern calculator 33 as initial values ("Yes" at S1150), to calculate (at S1160) detail cooling patterns for a lowest speed and a highest speed each supposed as a transfer speed of the rolling material 11, and subsequently determine (at S1170) whether or not all parameters in the calculated detail cooling patterns reside within ranges between upper and lower limits being contents of a constraint condition to the parameters, respectively.

Then, the detail cooling pattern calculator 34 operates when having determined that all parameters in the detail cooling patterns calculated at S1160 do not reside within ranges between upper and lower limits being contents of the constraint condition to the parameters, respectively ("No" at S1170), to make corrections (at S1180) from a parameter ranked at a lower order of precedence, within ranges between associated upper and lower limits, and again goes to the process of S1160.

To the contrary, the detail cooling pattern calculator 34 operates when having determined that all parameters in the detail cooling patterns reside within ranges between upper and lower limits being contents of the constraint condition to the parameters, respectively ("Yes" at S1170), to go to an end of processing in FIG. 11.

On the other hand, the detail cooling pattern calculator 34 operates when having determined in the decision process at S1150 to select using the simple cooling patterns calculated by the simple cooling pattern calculator 33 as target values ("No" at S1150), to calculate (at S1190) detail cooling patterns for a lowest speed and a highest speed each supposed as a transfer speed of the rolling material 11. In this situation, unlike the case of using as initial values, it operates (at S1190) to calculate detail cooling patterns for the lowest speed and the highest speed as supposed, without making corrections even if any parameter in the calculated detail cooling patterns outreaches an upper or lower limit being a content of the constraint condition to the parameters. With the foregoing steps, the processing in FIG. 11 goes an end.

The foregoing processing shown in FIG. 11 constitutes an initial set-point calculation process for the first, i.e., No. 1 strip segment at the detail cooling pattern calculator 34.

Then, the detail cooling pattern calculator 34 sets up, to the cooling controller 35, on/off patterns of valves 17*n*3 based on detail cooling patterns calculated through the foregoing initial set-point calculation process.

The cooling controller 35 is operable to take initial set-points of parameters calculated by the detail cooling pattern calculator 34 in such a manner as shown in FIG. 11, as a basis to perform a cooling control of the No. 1 strip segment (cooling control unit). For strip segments (cooling control units) subsequent to the No. 1, their parameters are to be determined every strip segment (cooling control unit) by the detail cooling pattern calculator 34 by way of a dynamic control shown in FIG. 12.

Figure 12:
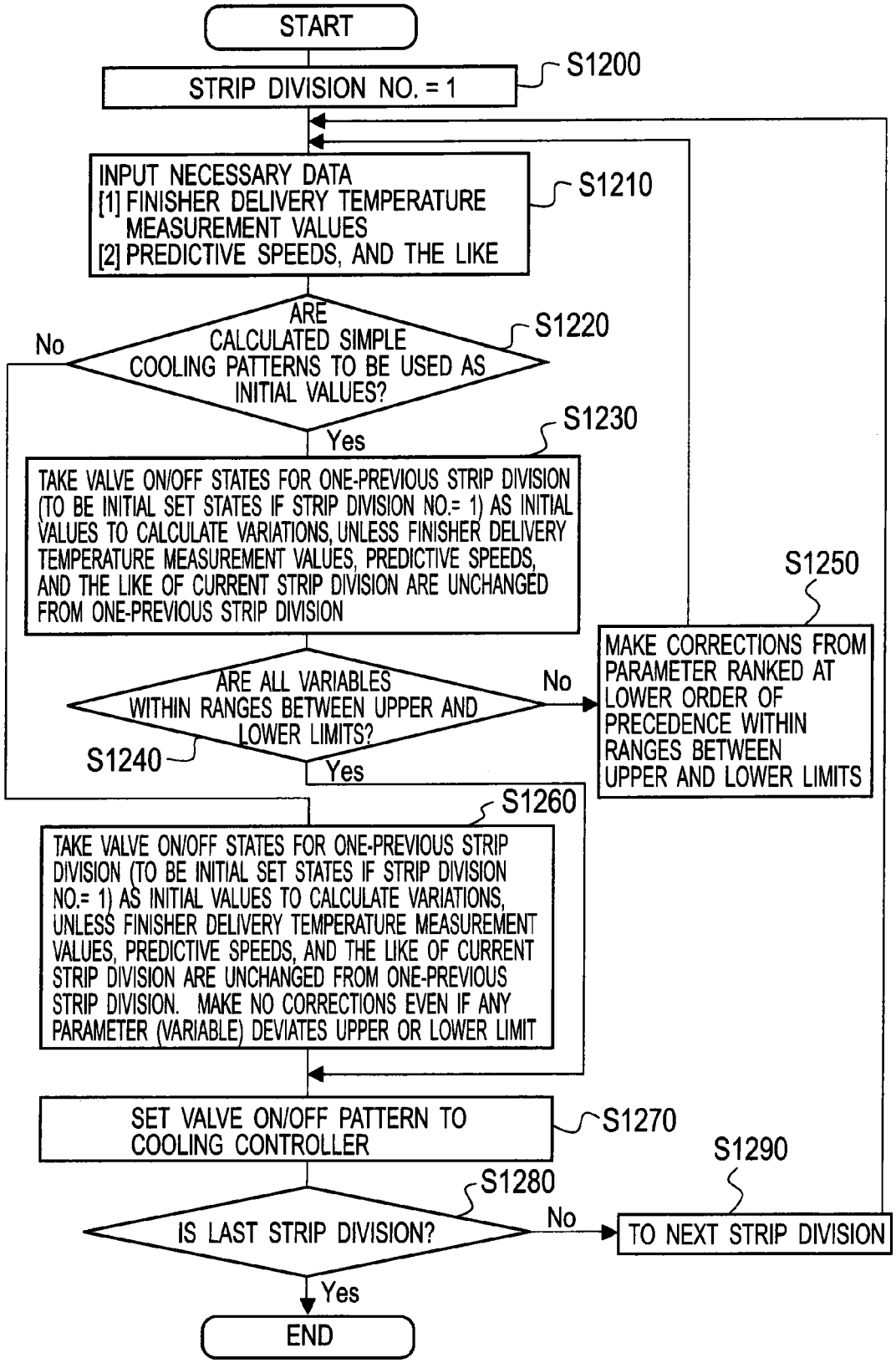
FIG. 12 is a flowchart showing an example of dynamic control to be applied to whole strip segments (cooling control units) after the initial setup calculation at the detail cooling pattern calculator 34.

Description is now made of an example of dynamic control applicable to all strip segments (cooling control units) after the initial value setup calculation, with reference to FIG. 12.

FIG. 12 is a flowchart showing an example of dynamic control to be applied to each of all strip segments (cooling control units) after the initial setup calculation at the detail cooling pattern calculator 34.

Namely, the detail cooling pattern calculator 34 first operates (at S1200) to set up No.=1 to the first strip segment, and subsequently inputs (at S1210) necessary data for cooling control from the finisher setup calculator 20 or such, including finisher delivery temperature measurement values, as well as predictive speed patterns, and the like.

Next (at S1220), the detail cooling pattern calculator 34 operates when using simple cooling patterns calculated by the simple cooling pattern calculator 33, to determine which to select between using as initial values and using as target values.

Here, the detail cooling pattern calculator 34 operates when having determined to select using the simple cooling patterns calculated by the simple cooling pattern calculator 33 as initial values ("Yes" at S1220), to check if the current strip segment has any change in its finisher delivery temperature measurement value, predictive speed, or such relative to a state of a one-previous strip segment (to be an initial set state if this strip segment is No.=1), and if any change is found, to calculate the variation (at S1230) by using on/off status of valves 17*n*3 associated with the one-previous strip segment as an initial value.

Next, the detail cooling pattern calculator 34 operates for each of two cases being a lowest speed and a highest speed in transfer speed of the rolling material 11, to determine (at S1240) whether or not all parameters in a simple cooling pattern calculated by the simple cooling pattern calculator 33 reside within ranges between upper and lower limits being contents of a constraint condition to the parameters, respectively, and when having determined that they do not reside within ranges between upper and lower limits being contents of the constraint condition ("No" at S1240), makes corrections (at S1250) from a parameter ranked at a lower order of precedence, within ranges between associated upper and lower limits, and again goes to the step S1310.

To the contrary, the detail cooling pattern calculator 34 operates when having determined for each of the two cases being the lowest speed and the highest speed in transfer speed of the rolling material 11 that all parameters in a simple cooling pattern calculated by the simple cooling pattern calculator 33 reside within ranges between upper and lower limits being contents of the constraint condition to the parameters, respectively ("Yes" at S1240), to set up (at S1270) on/off status of valves 17*n*3 for the strip segment, to the cooling controller 35.

Then, the detail cooling pattern calculator 34 operates to determine (at S1280) whether or not the current strip segment is a last strip segment, and when the current strip segment is the last strip segment ("Yes" at S1280), goes to an end of this process. On the hand, when having determined that the current strip segment is not the last strip segment ("No" at S1280), it operates (at S1290) to update the number of strip segment to the next. Then, it again goes to the process at the step S1310.

On the other hand, when having determined in the decision at S1220 not to select using the simple cooling patterns calculated by the simple cooling pattern calculator 33 as initial values ("No" at S1220), that is, when having determined to select using the simple cooling patterns as target values, the detail cooling pattern calculator 34 operates (at S1260) to check if the current strip segment has any change in its finisher delivery temperature measurement value, predictive speed, or such relative to a state of a one-previous strip segment (to be an initial set state if this strip segment is No.=1), and if any change is found, to calculate the variation by using on/off status of valves 17*n*3 associated with the one-previous strip segment as an initial value. In this case (S1260), the detail cooling pattern calculator 34 makes no correction even if parameters in a simple cooling pattern outreach ranges between upper and lower limits being contents of the constraint condition to the parameters.

Then, the detail cooling pattern calculator 34 operates (at S1270) to set to the cooling controller 35 an on/off pattern of valves 17*n*3 determined by a calculated detail cooling pattern.

Then, the cooling controller 35 is operable for each strip segment of No. 2 or sequential, to perform a cooling control based on an initial setting of parameters calculated by the detail cooling pattern calculator 34 as shown in FIG. 12.

Therefore, according to the example 1, the rolling material cooling control apparatus 30 is not adapted for use of a detail thermal model including a mathematical formula describing a temperature variation of a rolling material 11 in a prescribed cooling interval provided for cooling the rolling material, to directly calculate therefrom such a detail cooling pattern as shown in FIG. 9. But, it is configured such that, first, the influence coefficient calculator 32 takes a detail thermal model as a basis to calculate influence coefficients as necessary for a control of temperature variation of the rolling material, next, the simple cooling pattern calculator 33 takes the influence coefficients as bases to make calculation of a simple cooling pattern in a simplified form of a preferable detail cooling pattern being necessary for the rolling material to have a preferable material quality, further, the detail cooling pattern calculator 34 takes a combination of the simple cooling pattern and the detail thermal model as a basis to make calculation of a detail cooling pattern of the rolling material in the prescribed cooling interval, and the cooling controller 35 takes the detail cooling pattern as a basis to control a cooling of the rolling material 11. This allows for a lightened calculation load with a shortened time when calculating a detail cooling pattern.

In particular; according to the example 1, the rolling material cooling control apparatus 30 is operable to calculate influence coefficients from a detail thermal model, taking the calculated influence coefficients as bases to calculate a simple cooling pattern in a simplified form of a preferable detail cooling pattern being necessary for the rolling material 11 to have a preferable material quality, taking a combination of the calculated simple cooling pattern and the detail thermal model as a basis to calculate a detail cooling pattern of the rolling material in a prescribed cooling interval. It can thus work not simply to reduce calculation loads when calculating detail cooling patterns, but also to afford implements for limit avoidance, such as by accommodating parameters within upper and lower limits, when calculating simple cooling patterns with light calculation loads.

Therefore, according to the example 1, the rolling material cooling control apparatus 30 can serve to easily avoid such constraint conditions as constituting a bar to realize detail cooling patterns, thus permitting a preferable detail cooling pattern to be realized with ease. This affords to implement an optimal cooling control of rolling materials 11.

Detail thermal models addressing high-class steel strips and the like included multiple unknown parameters, giving rise to significant increased calculation loads in trials using a detail thermal model to directly determine a detail cooling pattern. This situation caused failures to determine an adequate detail cooling pattern every strip segment, constituting a difficulty to implement an optimal cooling control. However, as will be seen from the foregoing discussion, the rolling material cooling control apparatus 30 according to the example 1 permits a preferable detail cooling pattern to be determined every strip segment in a facilitated manner even for high-class steel strips and the like, allowing for a preferable material quality to be ensured with respect to high-class steel strips and the like.

Further, in the rolling material cooling control apparatus 30 according to the example 1, the simple cooling pattern calculator 33 is operable to geometrically approximate a temperature variation of the rolling material 11 in the prescribed cooling interval by way of an approximation of a cooling rate of the rolling material 11 using e.g. a straight line or a polynomial expression or an exponential or logarithmic algebraic expression, to make calculation of the simple cooling pattern in the simplified form of the preferable detail cooling pattern. When calculating a detail cooling pattern, it permits the calculation load to be reduced, allowing for a shortened calculation time. This corresponds to an optional processing in embodiments herein.

Further, in the rolling material cooling control apparatus 30 according to the example 1, the simple cooling pattern calculator 33 is operable to take the influence coefficient as a basis to calculate simple cooling patterns for a lowest speed and a highest speed compliant with the preferable detail cooling pattern being necessary for the rolling material 11 to have a preferable material quality, and determine for a respective parameter in the calculated simple cooling patterns whether or not a value thereof resides within a range between upper and lower limits of the respective parameter. The simple cooling pattern calculator 33 is adapted for operations unless the value of the respective parameter in the calculated simple cooling patterns resides within the range between the upper and lower limits of the respective parameter, to follow orders of precedence of parameters in the calculated simple cooling patterns, to make a parameter correction from a parameter ranked at a lower order of precedence, calculating simple cooling patterns, until respective parameters in thus calculated simple cooling patterns have values thereof residing within ranges of upper and lower limits thereof, respectively. It therefore is possible when calculating simple cooling patterns with lightened calculation loads, to implement an efficient limit avoidance, such as by accommodating parameters within upper and lower limits. This also corresponds to an optional processing in embodiments herein.

Further, in the rolling material cooling control apparatus 30 according to the example 1, the detail cooling pattern calculator 34 is operable to take values of parameters in the simple cooling pattern given by calculation at the simple cooling pattern calculator 33, as target values in calculation of the detail cooling pattern or initial values for calculation of the detail cooling pattern, to calculate detail cooling patterns for a lowest speed and a highest speed compliant with the preferable detail cooling pattern being necessary for the rolling material 11 to have a preferable material quality. This detail cooling pattern calculator 34 is adapted for operations when taking the values of parameters in the simple cooling pattern as the target values, to output detail cooling patterns calculated thereon. This detail cooling pattern calculator 34 is adapted for operations when taking the values of parameters in the simple cooling pattern as the initial values, to determine for a respective parameter in detail cooling patterns calculated thereon whether or not a value thereof resides within a range between upper and lower limits of the respective parameter. This detail cooling pattern calculator 34 is adapted to serve unless the value of the respective parameter in the calculated detail cooling patterns resides within the range between the upper and lower limits of the respective parameter, to follow orders of precedence of parameters in the calculated detail cooling patterns, to make a parameter correction from a parameter ranked at a lower order of precedence, calculating detail cooling patterns, until respective parameters in thus calculated detail cooling patterns have values thereof residing within ranges of upper and lower limits thereof, respectively. It thus permits a detail cooling pattern to be calculated with an enhanced precision, in a facilitated and ensured manner. This also corresponds to an optional processing in embodiments herein.

It is noted that the rolling material cooling control apparatus 30 according to the example 1 has been described as an example for a cooling control using a three-staged cooling pattern. It however is likewise applicable also to other cooling patterns, including an early stage cooling pattern, a latter stage cooling pattern, and a moderate cooling pattern.

EXAMPLE 2

Description is now made of a rolling material cooling control apparatus according to an example 2. It is noted that the configuration of the rolling material cooling control apparatus according to the example 2 is identical in a look to that of the rolling material cooling control apparatus 30 according to the example 1 shown 1 FIG. 3, so operations of the rolling material cooling control apparatus according to the example 2 are described with reference to the configuration of the rolling material cooling control apparatus 30 according to the example 1 shown in FIG. 3.

The rolling material cooling control apparatus according to the example 2 is configured for a control to minimize, i.e. reduce so far as possible, on/off actions (operations) of valves 17*n*3 at cooling banks 17*n*. The example 2 is described as an example employing a three-staged cooling pattern to perform a cooling control. It however is noted that the example is likewise applicable also to other cooling patterns including an early stage cooling pattern, a latter stage cooling pattern, and a moderate cooling pattern.

Figure 13:
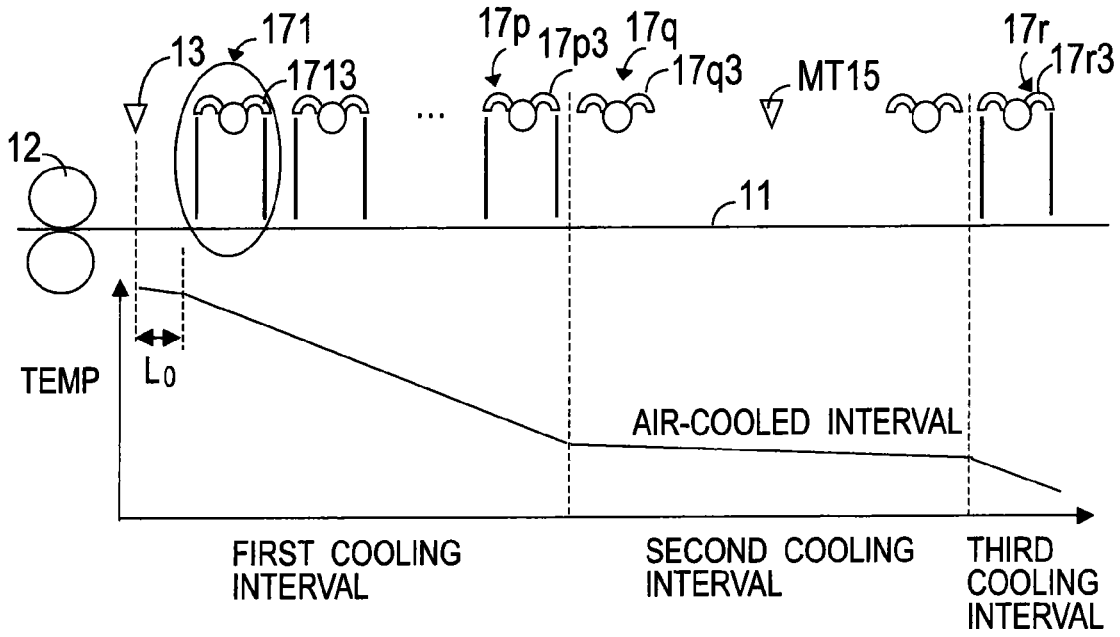
FIG. 13 is an explanatory diagram showing a valve at a most upstream cooling bank of a first cooling interval set up as a pivot valve to be always kept on (open) in an example 2.

Valves 17*n*3 at the cooling banks 17*n* are responsive with inevitable delays, as described. It therefore is preferable to hold back frequent on/off actions of the valves 17*n*3 as far as possible, this being the reason why on/off actions (operations) of valves 17*n*3 are reduced so far as possible at the cooling banks 17*n*. For instance, imagine a state shown in FIG. 13 in which a most upstream cooling bank 171 has its valve 1713 set up as a pivot valve to be always kept on (open). Note that even on a rolling material 11 the finisher delivery temperature is variable, as well as that the transfer speed of the rolling material 11 is variable. Therefore, in a cooling control executed under such the state, valves 17*n*3 are to be turned on/of as the control comes downstream, changing on/off status of a valve 17*p*3 at a most downstream cooling bank 17*p* of a first cooling interval.

In the three-staged cooling pattern, it also is essential to keep up the duration (of time) of the air-cooled interval being a second cooling interval, at a target value. For this reason, when on/off status of the valve 17*p*3 at the most downstream cooling bank 17*p* of the first cooling interval is changed, the duration (of time) of the air-cooled interval at the second cooling interval is to be kept by giving a commensurate change to on/off status of a valve 17*r*3 at a most upstream cooling bank 17*r* of a third cooling interval. It is noted that the duration (of time) of the air-cooled interval at the second cooling interval is variable depending on the transfer speed of the rolling material 11.

Therefore, if the second cooling interval includes frequent on/off actions of a valve 17*q*3 at a cooling bank 17*q* installed most upstream or most downstream, this event might cause a deteriorated precision in the cooling control, leading to a deterioration of a material quality, such as strength or ductility, of the rolling material.

Figure 14:
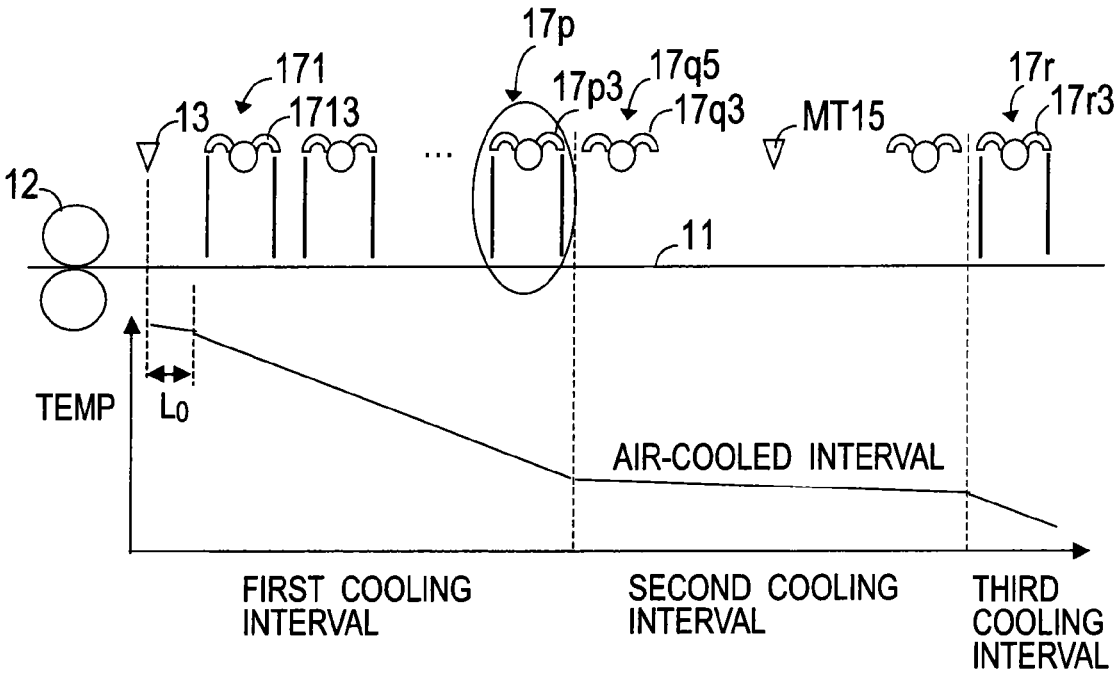
FIG. 14 is an explanatory diagram showing a valve at a most downstream cooling bank of the first cooling interval set up as a pivot valve to be always kept on (open) in the example 2.

To this point, the example 2 includes a cooling bank controller 352 adapted, as shown in FIG. 14, for a control to turn on a most upstream valve at a highest speed. In other words, the valve 17*p*3 at the most downstream cooling bank 17*p* of the first cooling interval is set up as a pivot valve to be always kept on (open), and valves 17*n*3 are controlled to turn on/off, as the control goes upstream from the valve 17*p*3 at the most downstream cooling bank 17*p* of the first cooling interval.

To this end, in the example 2, the cooling bank controller 352 is operable in advance for each of a lowest speed and a highest speed in transfer speed of a rolling material, to calculate in advance the number of valves of the first cooling interval required to turn on (open), and determine valve positions of prescribed upstream cooling banks 17*n* of the first cooling interval, so that valves are arrayed from the most downstream to a prescribed upstream of the first cooling interval when turned on (open) up to a maximal number.

Here, the valve 17*p*3 at the most downstream cooling bank 17*p* of the first cooling interval is set as a pivot valve to be always kept on (open), to thereby keep up the air-cooled duration of the second cooling interval, at a target value. To this end, the third cooling interval may have a most upstream on valve position thereof changed, taking into account variations of the air-cooled duration itself of the second cooling interval, such as those due to a variation in transfer speed of the rolling material, as well.

Then, the air-cooled duration of the second cooling interval depends on relations among the transfer speed of the rolling material, an on valve position at the most downstream cooling bank 17*p* of the first cooling interval, and an on valve position at the most upstream cooling bank 17*r* of the third cooling interval. It is noted that the transfer speed of the rolling material has a typical pattern in which it is accelerated before getting a constant speed, and afterward decelerated, so the on valve position at the most upstream cooling bank 17*r* of the third cooling interval is kept from changing little by little.

Such being the case, the valve 17*p*3 at the most downstream cooling bank 17*p* of the first cooling interval is always kept on (open), thereby successfully holding frequencies of on/off actions of respective valves 17*n*3 at lowest levels.

Therefore, like the rolling material cooling control apparatus according to the example 1, the rolling material cooling control apparatus according to the example 2 is adapted to calculate influence coefficients from a detail thermal model, take the influence coefficients as bases to calculate a simple cooling pattern, and determine a detail cooling pattern in accordance with the simple cooling pattern, whereby it is allowed when calculating the detail cooling pattern to have a reduced calculation load, and when implementing a cooling control to permit a facilitated limit avoidance. As a result, it can get with ease behind contents of a constraint condition constituting a bar against realization of a detail cooling pattern. It can thus afford to realize a desirable detail cooling pattern, and perform an optimal cooling control, allowing for ensured achievement of a desirable material quality.

In particular, the rolling material cooling control apparatus according to the example 2 is configured to set up the valve 17*p*3 at the most downstream cooling bank 17*p* of the first cooling interval as a pivot valve to be always kept on, and control valves to turn on/off, as the control goes upstream, whereby it is allowed for a control to minimize on/off actions (operations) of valves 17*n*3 at the respective cooling banks 17*n*. The rolling material cooling control apparatus according to the example 2 can thus afford to successfully reduce adverse effects of response delays of valves 17*n*3, when compared with a configuration in which a valve 1713 at a most upstream cooling bank 171 of a water-cooled first cooling interval is set up as a pivot valve to be always kept on (open), and valves are controlled to turn on/off, as the control comes downstream. As a result, it is enabled to perform a feedback control for a target value to be kept, while retaining a preferable detail cooling pattern. This permits a highly precise cooling pattern control to be realized, with an enhanced precision of cooling control, and with an enhanced material quality, such as strength or ductility, of a rolling material.

EXAMPLE 3

Description is now made of a rolling material cooling control apparatus 40 according to an example 3.

According to the example 3, the rolling material cooling control apparatus 40 is configured to operate, when given a preferable temperature, a cooling rate, durations to be air-cooled, and the like to realize a preferable material quality such as strength or ductility of a rolling material 11, if among them the cooling rate is ranked higher in order of precedence than the preferable temperature, not to follow a control system for injecting water directly from cooling banks near a thermometer, as a feedback control of a deviation between a target temperature and a measured temperature, but to implement a feedback control for using a deviation between a target temperature and a measured temperature, to correct the target temperature.

In this regard, in the rolling material cooling control apparatus 30 according to the example 1 and the like, the feedback (FB) controller 353 is operable for a feedback control to use cooling banks 17N-1 and 17N near the coiling temperature pyrometer (CT) 14 for the purpose of controlling a final coiling temperature at the coiling temperature pyrometer (CT) 14. Instead, the rolling material cooling control apparatus 40 according to the example 3 is adapted, for protection of the cooling rate being essential for a material quality to be secured, to avoid executing such a feedback control as using cooling banks 17N-1, 17N, et al. for local injection of water.

The reason why the cooling banks 17N-1 and 17N are used for local water injection resides in that the shorter the distance from a cooling bank at an operation end to the coiling temperature pyrometer (CT) 14, the shorter the dead time with an increased tendency to provide control performance.

However, the early stage cooling pattern shown in FIG. 5 as well as the moderate cooling pattern shown in FIG. 7 includes the second air-cooled interval as a last cooling interval connected to a location of the coiling temperature pyrometer (CT) 14, with a relatively long duration of time secured therefor. Hence, when trying, like the rolling material cooling control apparatus 30 in the example 1 including the feedback (FB) controller 353 for a feedback control, to use the cooling banks 17N-1 and 17N near the coiling temperature pyrometer (CT) 14 to control a final coiling temperature at the coiling temperature pyrometer (CT) 14, the early stage cooling pattern as well as the moderate cooling pattern may have the water-cooled interval invading the second air-cooled interval.

Also, the latter stage cooling pattern shown in FIG. 6 as well as the three-staged cooling pattern shown in FIG. 8 includes an air-cooled interval (i.e. the second air-cooled interval in FIG. 6 or the final air-cooled interval in FIG. 8) as a final cooling interval connected to the coiling temperature pyrometer (CT) 14, though having a short duration of time. Hence, when trying to operate the feedback (FB) controller 353 for a feedback control to use the cooling banks 17N-1 and 17N near the coiling temperature pyrometer (CT) 14 to control a final coiling temperature at the coiling temperature pyrometer (CT) 14, the latter stage cooling pattern as well as the three-staged cooling pattern may have a cooling rate at a last water-cooled cooling interval (i.e. the first cooling interval in FIG. 6 or the third cooling interval in FIG. 8) changed, constituting an unintentional change in cooling rate.

When given a preferable temperature, a cooling rate, and durations to be air-cooled to be set up to realize a preferable material quality such as strength or ductility of a rolling material, if among them the cooling rate is ranked higher in order of precedence than the temperature, it is preferable to avoid using the feedback (FB) controller 353 for a feedback control as a control system for injecting water directly from the cooling banks 17N-1 and 17N near the coiling temperature pyrometer (CT) 14.

For a similar reason, when the cooling rate has a priority to temperature, even if the intermediate temperature at the intermediate temperature pyrometer (MT) 15 is given a target value, it is preferable to avoid using a measured value on the intermediate temperature pyrometer (MT) 15 to make a feedback control for a direct change of water injection amount at a just proximal upstream cooling bank of the intermediate temperature pyrometer (MT) 15.

To this point, the rolling material cooling control apparatus according to the example 3 is configured as an implement for protection of the cooling rate being essential for a preferable material quality to be secured, not to operate the feedback (FB) controller 353 for using cooling banks 17N-1, 17N, et al. for local injection of water to achieve a target value at the coiling temperature pyrometer (CT) 14, but to correct an internal temperature target value to thereby achieve a target value at the coiling temperature pyrometer (CT) 14.

Figure 15:
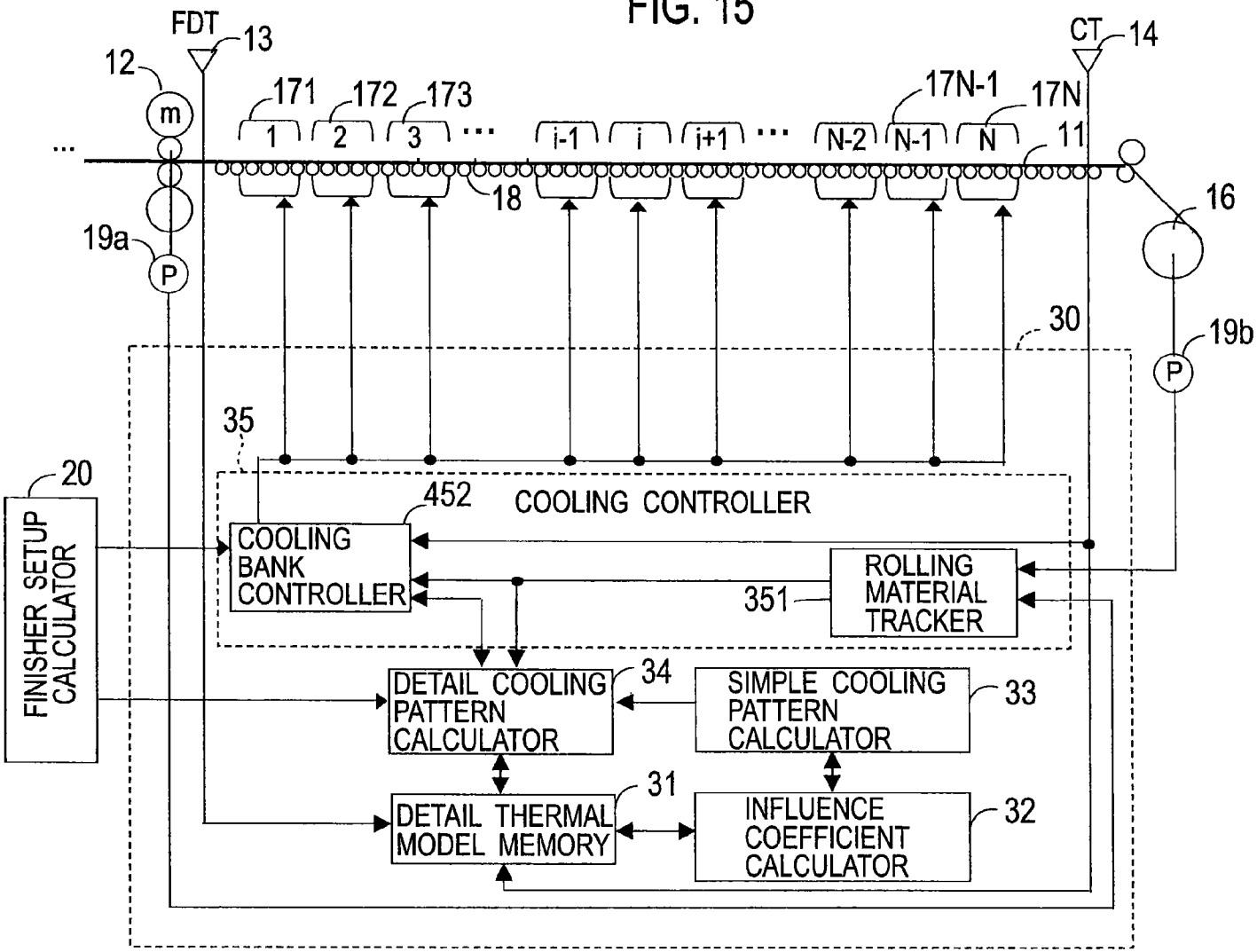
FIG. 15 is a block diagram showing an example of configuration of a rolling material cooling control apparatus according to an example 3 of embodiment.

FIG. 15 is a diagram showing an example of configuration of the rolling material cooling control apparatus 40 according to the example 3.

Figure 16:
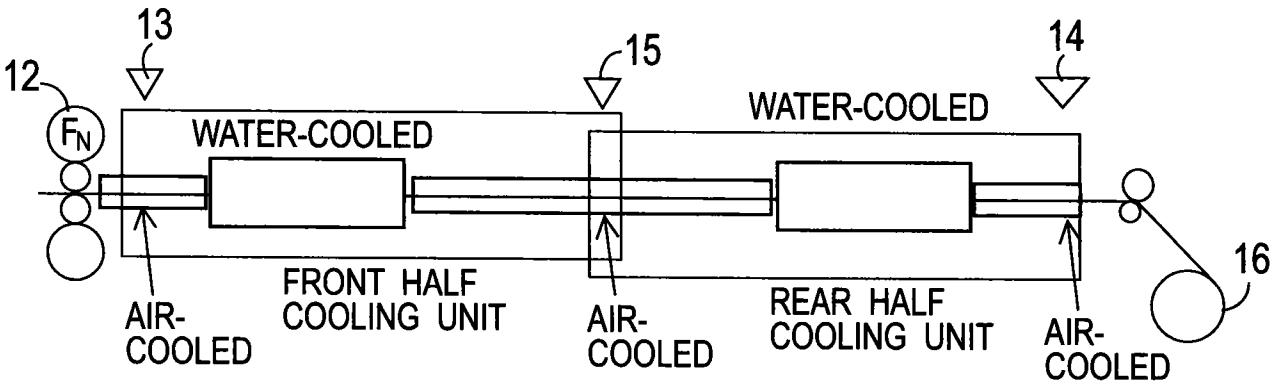
FIG. 16 is an explanatory diagram showing an example of feedback control for correcting an internal temperature target value in the rolling material cooling control apparatus according to the example 3.

In FIG. 15, the rolling material cooling control apparatus 40 according to the example 3 is configured as a modification of the rolling material cooling control apparatus 30 in the example 1 shown in FIG. 3, in which the function of feedback (FB) controller 353 is omitted, and a cooling controller 45 includes a cooling bank controller 452 and the like for a modified feedback temperature control to correct an internal temperature target value on bases of a coiling temperature, an intermediate temperature, and the like measured by a coiling temperature pyrometer (CT) 14, an intermediate temperature pyrometer (MT) 15, and the like, as shown in the next FIG. 16. It is noted that, for the correction of an internal temperature target value, there may well be independent provision of a feedback temperature controller, instead of adding a feedback temperature control function to the cooling bank controller 452.

FIG. 16 is an explanatory diagram showing an example of feedback control for correcting an internal temperature target value in the rolling material cooling control apparatus according to the example 3.

FIG. 16 shows an example in which like FIG. 1 a single intermediate temperature pyrometer (MT) 15 is installed on a transfer table (ROT) 10, for the sake of convenient description. The transfer table (ROT) 10 has installed thereon a finisher delivery temperature pyrometer (FDT) 13 at an initial point, and a coiling temperature pyrometer (CT) 14 at a final point.

There is provided a front half cooling unit extending from the finisher delivery temperature pyrometer (FDT) 13 to the intermediate temperature pyrometer (MT) 15, in combination with a rear half cooling unit extending from the intermediate temperature pyrometer (MT) to the coiling temperature pyrometer (CT) 14.

In the example 3, the cooling bank controller 452 is operable at the front half cooling unit to add a deviation between an intermediate temperature target value of the intermediate temperature pyrometer (MT) 15 and an intermediate temperature measurement value at the intermediate temperature pyrometer (MT) 15 to an intermediate temperature internal target value of the intermediate temperature pyrometer (MT) 15, thereby correcting this, and control cooling banks between the finisher delivery temperature pyrometer (FDT) 13 and the intermediate temperature pyrometer (MT) 15, so that an intermediate temperature measurement value at the intermediate temperature pyrometer (MT) 15 attains a corrected intermediate temperature internal target value.

Namely, the cooling bank controller 452 in the example 3 is operable to change the duration of time of a water-cooled interval between the finisher delivery temperature pyrometer (FDT) 13 and the intermediate temperature pyrometer (MT) 15, to thereby keep a set cooling rate unchanged.

To the contrary, the cooling bank controller 452 in the example 3 is operable at the rear half cooling unit to add a deviation between a coiling temperature target value of the coiling temperature pyrometer (CT) 14 and a coiling temperature measurement value at the coiling temperature pyrometer (CT) 14 to a coiling temperature internal target value, thereby correcting this, and control cooling banks between the intermediate temperature pyrometer (MT) 15 and the coiling temperature pyrometer (CT) 14, so that a coiling temperature measurement value at the coiling temperature pyrometer (CT) 14 attains a corrected coiling temperature target value.

Namely, the cooling bank controller 452 in the example 3 is operable to change the duration of time of a water-cooled interval between the intermediate temperature pyrometer (MT) 15 and the coiling temperature pyrometer (CT) 14, to thereby keep a set cooling rate unchanged.

It is noted that the cooling bank controller 452 in the example 3 may execute such a control as described above every prescribed time, a plurality of times, so that at the front half cooling unit and the rear half cooling unit the intermediate temperature pyrometer (MT) 15 or the coiling temperature pyrometer (CT) attains a corrected intermediate temperature internal target value or a corrected coiling temperature target value, respectively.

When the cooling bank controller 452 in the example 3 has executed such a control as described above every prescribed time, a plurality of times, the coiling temperature pyrometer (CT) 14 has a coiling temperature measurement value, which can be defined in terms of a mathematical formula, by using an expression 14 below. It is noted that also for the intermediate temperature the value can be likewise defined.

[Math 8]

$$T_C^{InnerAIM}(j)=T_C^{InnerAIM}(j-1)+k(T_C^{OrgAim}-T_C^{Meas}) \quad \text{(expression14)}$$

Here, in the expression 14:

j: number of times of control;

$T_C^{InnerAIM}$: coiling temperature internal target value;

k: gain;

$T_C^{Org/Aim}$: original target value of coiling temperature; and $T_C^{Meas}$: coiling temperature measurement value.

It is noted that also for the intermediate temperature the value can be likewise defined. In the case of a plurality of intermediate temperature pyrometer (MT) 15, the number may be assumed as a maximal number, that is, the cooling units between thermometers may be each divided, for a control to be likewise executed.

Therefore, like the rolling material cooling control apparatus 30 according to the example 1, the rolling material cooling control apparatus 40 according to the example 3 is adapted to calculate influence coefficients from a detail thermal model, take the influence coefficients as bases to calculate a simple cooling pattern, and determine a detail cooling pattern in accordance with the simple cooling pattern, whereby it is allowed when calculating the detail cooling pattern to have a reduced calculation load, and when implementing a cooling control to permit a facilitated limit avoidance. As a result, it can get with ease behind contents of a constraint condition constituting a bar against realization of a detail cooling pattern. It can thus afford to realize a desirable detail cooling pattern, and perform an optimal cooling control, allowing for ensured achievement of a desirable material quality.

In particular, the rolling material cooling control apparatus according to the example 3 is configured as an implement for protection of the cooling rate being essential for a preferable material quality to be secured, not to operate the feedback (FB) controller 353 for using cooling banks 17N-1, 17N, et al. near the coiling temperature pyrometer (CT) 14 for local injection of water to achieve a target value at the coiling temperature pyrometer (CT) 14, but to operate the cooling bank controller 452 in the example 3 for adding a deviation between a target value of a thermometer and a temperature measurement value at the thermometer to a temperature internal target value of the thermometer, thereby correcting this, and controlling cooling banks within an interval up to the thermometer so that a temperature measurement value at the thermometer attains a corrected temperature internal target value, whereby it is allowed to prevent a water-cooled interval from invading an air-cooled interval, as well as a cooling rate from being changed unintentionally, and operate to retain a cooling rate with a priority, even when the cooling rate is ranked higher in order of precedence than a preferable temperature among the temperature, the cooling rate, and an air-cooled duration of time to be set up to realize a preferable material quality such as strength or ductility of a rolling material.

It is noted that the rolling material cooling control apparatus 30 or 40 in any one of the examples 1 through 3 described is applied to a hot strip rolling line, while embodiments herein are in no way limited thereto, and are likewise applicable even to rolling plants such as other forms of hot strip rolling lines, plate rolling lines, and cold rolling lines, as they have similar cooling banks.

Further, the rolling material cooling control apparatus in any one of the examples 1 through 3 of embodiment described has an example of hardware configuration as shown in FIG. 3, while embodiments herein are in no way limited thereto. There may well be a rolling material cooling control apparatus or a rolling material cooling control method according to embodiments herein implemented like software in a control apparatus or a computer apparatus including a CPU, and a memory having stored a rolling material cooling control program adapted to have operations executed like any example described.

Further, the examples 1 through 3 described are consistent examples of embodiments herein including various parameters and values as examples therein, and can accommodate corrections or such without being restricted thereto, within a scope not trespassing substances of embodiments herein.

Industrial Applicability

As will be seen from the foregoing, rolling material cooling control apparatuses, rolling material cooling control methods, and rolling material cooling control programs according to embodiments herein are adapted to implement calculating influence coefficients as necessary for a control of parameters based on a detail thermal model including a mathematical formula using parameters describing a temperature variation of a rolling material in a prescribed cooling interval, taking calculated influence coefficients as a basis to calculate a simple cooling pattern in a simplified form of a preferable detail cooling pattern being necessary for the rolling material to have a preferable material quality (such as strength or ductility), taking a combination of the calculated simple cooling pattern and the detail thermal model as a basis to calculate a detail cooling pattern of the rolling material in the prescribed cooling interval, and taking the calculated detail cooling pattern as a basis to control a cooling of the rolling material, whereby they are allowed when calculating a detail cooling pattern of a rolling material from a detail thermal model to have a reduced calculation load in comparison with using the detail thermal model to directly calculate a detail cooling pattern, afford to execute an optimal cooling control, allowing for an efficient control of a material quality as necessary for production of high-class steel strips or such, as advantages effects, and cover objects of application including rolling material cooling control apparatuses, rolling material cooling control methods, and rolling material cooling control programs such as those for hot strip rolling lines, plate rolling lines, cold rolling lines, or such, having high levels of industrial applicability to those rolling material cooling control apparatuses, rolling material cooling control methods, and rolling material cooling control programs.

Reference Signs List

20 . . . a finisher setup calculator
30, 40 . . . rolling material cooling control apparatuses
31 . . . a detail thermal model memory
32 . . . an influence coefficient calculator
33 . . . a simple cooling pattern calculator
34 . . . a detail cooling pattern calculator
35 and 45 . . . cooling controllers
351 . . . a rolling material tracker
352 and 452 . . . cooling bank controllers
353 . . . a feedback (FB) controller

The invention claimed is:

1. A rolling material cooling control apparatus comprising:

a detail thermal model memory having stored detail thermal models each comprising a mathematical formula using parameters describing a temperature variation of a rolling material in a prescribed cooling interval;

an influence coefficient calculator configured to take a detail thermal model stored in the detail thermal model memory as a basis to calculate an influence coefficient as necessary for a control of temperature variation of the rolling material;

a simple cooling pattern calculator configured to take the influence coefficient calculated by the influence coefficient calculator as a basis to make calculation of a simple cooling pattern in a simplified form of a preferable detail cooling pattern being necessary for the rolling material to have a preferable material quality;

a detail cooling pattern calculator configured to take a combination of the simple cooling pattern given by calculation at the simple cooling pattern calculator and the detail thermal model stored in the detail thermal model memory as a basis to make calculation of a detail cooling pattern of the rolling material in the prescribed cooling interval; and a cooling controller configured to take the detail cooling pattern given by calculation at the detail cooling pattern calculator as a basis to control a cooling of the rolling material.

2. The rolling material cooling control apparatus according to claim 1, wherein the simple cooling pattern calculator is configured to geometrically approximate a temperature variation of the rolling material in the prescribed cooling interval by way of an approximation of a cooling rate of the rolling material using a straight line or a polynomial expression or an exponential or logarithmic algebraic expression, to make calculation of the simple cooling pattern in the simplified form of the preferable detail cooling pattern.

3. The rolling material cooling control apparatus according to claim 1, wherein the simple cooling pattern calculator is:

configured to take the influence coefficient calculated by the influence coefficient calculator as a basis to calculate simple cooling patterns for a lowest speed and a highest speed compliant with the preferable detail cooling pattern being necessary for the rolling material to have a preferable material quality, and determine for a respective parameter in the calculated simple cooling patterns whether or not a value thereof resides within a range between upper and lower limits of the respective parameter; and adapted for operations unless the value of the respective parameter in the calculated simple cooling patterns resides within the range between the upper and lower limits of the respective parameter, to follow orders of precedence of parameters in the calculated simple cooling patterns, to make a parameter correction from a parameter ranked at a lower order of precedence, calculating simple cooling patterns, until respective parameters in thus calculated simple cooling patterns have values thereof residing within ranges of upper and lower limits thereof, respectively.

4. The rolling material cooling control apparatus according to claim 1, wherein the detail cooling pattern calculator is:

configured to take values of parameters in the simple cooling pattern given by calculation at the simple cooling pattern calculator, as target values in calculation of the detail cooling pattern or initial values for calculation of the detail cooling pattern, to calculate detail cooling patterns for a lowest speed and a highest speed compliant with the preferable detail cooling pattern being necessary for the rolling material to have a preferable material quality;

adapted for operations when taking the values of parameters in the simple cooling pattern as the target values, to output detail cooling patterns calculated thereon; and adapted for operations when taking the values of parameters in the simple cooling pattern as the initial values, to determine for a respective parameter in detail cooling patterns calculated thereon whether or not a value thereof resides within a range between upper and lower limits of the respective parameter, and serve unless the value of the respective parameter in the calculated detail cooling patterns resides within the range between the upper and lower limits of the respective parameter, to follow orders of precedence of parameters in the calculated detail cooling patterns, to make a parameter correction from a parameter ranked at a lower order of precedence, calculating detail cooling patterns, until respective parameters in thus calculated detail cooling patterns have values thereof residing within ranges of upper and lower limits thereof, respectively.

5. The rolling material cooling control apparatus according to claim 1, wherein the cooling controller is adapted for operations when implementing the detail cooling pattern of the rolling material in a form of a three-staged cooling pattern through three stages being a water-cooled first cooling interval, an air-cooled second cooling interval, and a water-cooled third cooling interval, to always keep on a valve at a downstream end of the first cooling interval, securing an air-cooling time as the second cooling interval, to simply correct a position of a valve to be turned on at an upstream end of the third cooling interval.

6. The rolling material cooling control apparatus according to claim 1, wherein the cooling controller is adapted for operations when a preferable cooling rate is higher in an order of precedence than a preferable temperature to be given to realize a preferable material quality of the rolling material, to feed back a deviation between a target temperature and a measured temperature, to add to the target temperature, to set as an internal temperature target value, and control a cooling of the rolling material to attain the internal temperature target value.

7. A rolling material cooling control method for rolling materials, comprising:

a step of calculating an influence coefficient as necessary for a control of temperature variation of a rolling material based on a detail thermal model using a mathematical formula describing a temperature variation of the rolling material in a prescribed cooling interval provided to cool the rolling material;

a step of taking the calculated influence coefficient as a basis to calculate a simple cooling pattern in a simplified form of a preferable detail cooling pattern being necessary for the rolling material to have a preferable material quality;

a step of taking a combination of the calculated simple cooling pattern and the detail thermal model as a basis to calculate a detail cooling pattern of the rolling material in the prescribed cooling interval; and a step of taking the calculated detail cooling pattern as a basis to control a cooling of the rolling material.

8. A rolling material cooling control program for rolling materials stored on a non-transitory computer-readable storage medium, comprising, for a computer adapted to execute:

a step of calculating an influence coefficient as necessary for a control of temperature variation of a rolling material based on a detail thermal model using a mathematical formula describing a temperature variation of the rolling material in a prescribed cooling interval provided to cool the rolling material;

a step of taking the calculated influence coefficient as a basis to calculate a simple cooling pattern in a simplified form of a preferable detail cooling pattern being necessary for the rolling material to have a preferable material quality;

a step of taking a combination of the calculated simple cooling pattern and the detail thermal model as a basis to calculate a detail cooling pattern of the rolling material in the prescribed cooling interval; and a step of taking the calculated detail cooling pattern as a basis to control a cooling of the rolling material.

* * * * *